US010875316B2

(12) United States Patent
Kudo et al.

(10) Patent No.: US 10,875,316 B2
(45) Date of Patent: Dec. 29, 2020

(54) LIQUID SUPPLY UNIT AND LIQUID EJECTION APPARATUS

(71) Applicant: SEIKO EPSON CORPORATION, Tokyo (JP)

(72) Inventors: Shoma Kudo, Shiojiri (JP); Naomi Kimura, Okaya (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/373,337

(22) Filed: Apr. 2, 2019

(65) Prior Publication Data

US 2019/0299633 A1 Oct. 3, 2019

(30) Foreign Application Priority Data

Apr. 3, 2018 (JP) ..... 2018-071382

(51) Int. Cl.
*B41J 2/175* (2006.01)
*B41J 29/13* (2006.01)

(52) U.S. Cl.
CPC ..... *B41J 2/17523* (2013.01); *B41J 2/1752* (2013.01); *B41J 2/17509* (2013.01); *B41J 2/17553* (2013.01); *B41J 29/13* (2013.01)

(58) Field of Classification Search
CPC .. B41J 2/17523; B41J 2/1752; B41J 2/17509; B41J 2/17553; B41J 29/13; B41J 2/17513
See application file for complete search history.

(56) References Cited

U.S. PATENT DOCUMENTS 5,838,352 A * 11/1998 Martinez ..... B41J 2/17506 347/87
6,053,604 A * 4/2000 Sato ..... B41J 2/17513 347/85
2016/0006003 A1* 1/2016 Ohashi ..... H01M 2/1094 429/175
2017/0355191 A1 12/2017 Mizutani et al.
2018/0178567 A1* 6/2018 Takabayashi ..... B41J 2/17513
2019/0291445 A1* 9/2019 Yamada ..... B41J 2/17509

FOREIGN PATENT DOCUMENTS

JP 2017-222152 A 12/2017

* cited by examiner

*Primary Examiner* — Justin Seo
(74) *Attorney, Agent, or Firm* — Oliff PLC

(57) ABSTRACT

The liquid supply unit includes: a liquid containing body configured to contain the liquid; a housing that covers the liquid containing body; and a lever-shaped plug member configured to seal the liquid injection portion. The plug member includes: a first pivoting portion that is configured to pivot the plug member; and a first protrusion provided so as to be displaceable in order to lock the plug member onto the housing. The housing includes: a second pivoting portion into which the first pivoting portion is to be fit; and a second protrusion configured to come into contact with the first protrusion and displace the first protrusion when the plug member pivots toward the liquid injection portion, the contact with the first protrusion being canceled and the displacement of the first protrusion being returned to normal when the plug member further pivots and is locked onto the housing.

20 Claims, 20 Drawing Sheets

LIQUID SUPPLY UNIT AND LIQUID EJECTION APPARATUS

BACKGROUND

The present application is based on, and claims priority from JP Application Serial Number 2018-071382, filed Apr. 3, 2018, the disclosure of which is hereby incorporated by reference herein in its entirety.

1. Technical Field

The present disclosure relates to a liquid supply unit and a liquid ejection apparatus.

2. Related Art

Hereinbefore, an ink supply unit has been known (e.g., JP-A-2017-222152) which includes: an ink storage chamber for storing ink; an ink inlet that is provided in the ink storage chamber and through which ink can be injected into the ink storage chamber; and a cap support member for supporting an elastic cap configured to seal the ink inlet.

JP-A-2017-222152 is an example of the related art.

With the above-described ink supply unit, the user needs to confirm by eyesight whether or not the elastic cap is locked onto (sealed to) the ink inlet. However, the locked state of the ink inlet cannot be sufficiently confirmed using only eyesight, and if the locked state of the ink inlet is insufficient, the ink in the ink storage chamber will flow out from the ink inlet. Thus, it has been difficult to check whether or not the members are correctly locked using only eyesight.

SUMMARY

A liquid supply unit of the present disclosure is a liquid supply unit configured to supply a liquid to a liquid ejection head of a liquid ejection apparatus, the liquid supply unit including: a liquid containing body configured to contain the liquid; a liquid injection portion that is provided in the liquid containing body and through which the liquid can be injected into the liquid containing body; a housing that covers the liquid containing body; and a lever-shaped plug member configured to seal the liquid injection portion. The plug member includes: a first pivoting portion that is configured to pivot the plug member; and a first protrusion provided so as to be displaceable in order to lock the plug member onto the housing. The housing includes: a second pivoting portion into which the first pivoting portion is to be fit; and a second protrusion configured to come into contact with the first protrusion and displace the first protrusion when the plug member pivots toward the liquid injection portion, the contact with the first protrusion being canceled and the displacement of the first protrusion being returned to normal when the plug member further pivots and is locked onto the housing.

In the above-described liquid supply unit, the first protrusion and the second protrusion may be arranged so as to be in a positional relationship in which the liquid injection portion is sealed by the plug member when the plug member pivots and is locked onto the housing.

The housing of the liquid supply unit may include a third protrusion configured to, when the plug member pivots away from the liquid injection portion, restrict the pivoting of the plug member and perform locking by coming into contact with an end portion on the first pivoting portion side of the plug member.

The end portion of the liquid supply unit may be provided with a fourth protrusion configured to come into contact with the third protrusion when locked by the third protrusion.

In the above-described liquid supply unit, the liquid containing body may include: a first positioning portion configured to perform positioning on a mounting axis when mounted in the housing; and a pressed portion to be pressed from one direction on the mounting axis by the housing. The housing may include: a first housing that covers the liquid containing body from one direction on the mounting axis; a second housing opposing the first housing; a second positioning portion that is provided in the second housing and is configured to lock the first positioning portion; and a pressing portion that is provided in the first housing and is configured to press the pressed portion in the one direction on the mounting axis. In the liquid containing body, when the pressed portion is pressed by the pressing portion, the first positioning portion may be locked onto the second positioning portion in conjunction with the pressing.

A liquid supply unit of the present disclosure is a liquid supply unit configured to supply a liquid to a liquid ejection head of a liquid ejection apparatus, the liquid supply unit including: a liquid containing body configured to contain the liquid; a liquid injection portion that is provided in the liquid containing body and through which the liquid can be injected into the liquid containing body; a housing that covers the liquid containing body; and a lever-shaped plug member configured to seal the liquid injection portion. The plug member includes: a first pivoting portion that is configured to pivot the plug member; and a first protrusion that is configured to lock the plug member onto the housing. The housing includes: a second pivoting portion into which the first pivoting portion is to be fit; and a second protrusion that is provided so as to be displaceable, and is configured to come into contact with the first protrusion and be displaced when the plug member pivots toward the liquid injection portion, the contact with the protrusion being canceled and the displacement returning to normal when the plug member further pivots and is locked onto the housing.

In the above-described liquid supply unit, the first protrusion and the second protrusion may be arranged at a position at which the liquid injection portion is sealed by the plug member when the plug member pivots and is locked onto the housing.

The housing of the liquid supply unit may include a third protrusion configured to, when the plug member pivots away from the liquid injection portion, restrict the pivoting of the plug member and perform locking by coming into contact with an end portion on the first pivoting portion side of the plug member.

The end portion of the liquid supply unit may be provided with a fourth protrusion configured to come into contact with the third protrusion when locked by the third protrusion.

In the above-described liquid supply unit, the liquid containing body may include: a first positioning portion configured to perform positioning on a mounting axis when mounted in the housing; and a pressed portion to be pressed from one direction on the mounting axis by the housing. The housing may include: a first housing that covers the liquid containing body from one direction on the mounting axis; a second housing opposing the first housing; a second positioning portion that is provided in the second housing and is configured to lock the first positioning portion; and a pressing portion that is provided in the first housing and is configured to press the pressed portion in the one direction on the mounting axis. In the liquid containing body, when the pressed portion is pressed by the pressing portion, the first positioning portion may be locked onto the second positioning portion in conjunction with the pressing.

A liquid supply unit of the present disclosure is a liquid supply unit configured to supply a liquid to a liquid ejection head of a liquid ejection apparatus, the liquid supply unit including: a liquid containing body configured to contain the liquid; a liquid injection portion that is provided in the liquid containing body and through which the liquid can be injected into the liquid containing body; and a lever-shaped plug member configured to seal the liquid injection portion. The plug member includes: a first pivoting portion that is configured to pivot the plug member; and a first protrusion provided so as to be displaceable in order to lock the plug member onto the liquid containing body. The liquid containing body includes: a second pivoting portion into which the first pivoting portion is to be fit; and a second protrusion configured to come into contact with the first protrusion and displace the first protrusion when the plug member pivots toward the liquid injection portion, the contact with the first protrusion being canceled and the displacement of the first protrusion being returned to normal when the plug member further pivots and is locked onto the liquid containing body.

In the above-described liquid supply unit, the first protrusion and the second protrusion may be arranged at a position at which the liquid injection portion is sealed by the plug member when the plug member pivots and is locked onto the liquid containing body.

The liquid containing body of the liquid supply unit may include a third protrusion configured to, when the plug member pivots away from the liquid injection portion, restrict the pivoting of the plug member and perform locking by coming into contact with an end portion on the first pivoting portion side of the plug member.

The end portion of the liquid supply unit may be provided with a fourth protrusion configured to come into contact with the third protrusion when locked by the third protrusion.

A liquid supply unit of the present disclosure is a liquid supply unit configured to supply a liquid to a liquid ejection head of a liquid ejection apparatus, the liquid supply unit including: a liquid containing body configured to contain the liquid; a liquid injection portion that is provided in the liquid containing body and through which the liquid can be injected into the liquid containing body; and a lever-shaped plug member configured to seal the liquid injection portion. The plug member includes: a first pivoting portion that is configured to pivot the plug member; and a first protrusion that is configured to lock the plug member onto the liquid containing body. The liquid containing body includes: a second pivoting portion into which the first pivoting portion is to be fit; and a second protrusion that is provided so as to be displaceable, and is configured to come into contact with the first protrusion and be displaced when the plug member pivots toward the liquid injection portion, the contact with the protrusion being canceled and the displacement returning to normal when the plug member further pivots and is locked onto the liquid containing body.

In the above-described liquid supply unit, the first protrusion and the second protrusion may be arranged at a position at which the liquid injection portion is sealed by the plug member when the plug member pivots and is locked onto the liquid containing body.

The liquid containing body of the liquid supply unit may include a third protrusion configured to, when the plug member pivots away from the liquid injection portion, restrict the pivoting of the plug member and perform locking by coming into contact with an end portion on the first pivoting portion side of the plug member.

The end portion of the liquid supply unit may be provided with a fourth protrusion configured to come into contact with the third protrusion when locked by the third protrusion.

A liquid ejection apparatus of the present disclosure includes: a liquid ejection head; and the above-described liquid supply unit.

DESCRIPTION OF EXEMPLARY EMBODIMENTS

First Embodiment

First, a configuration of a liquid supply apparatus will be described.

Figure 1:
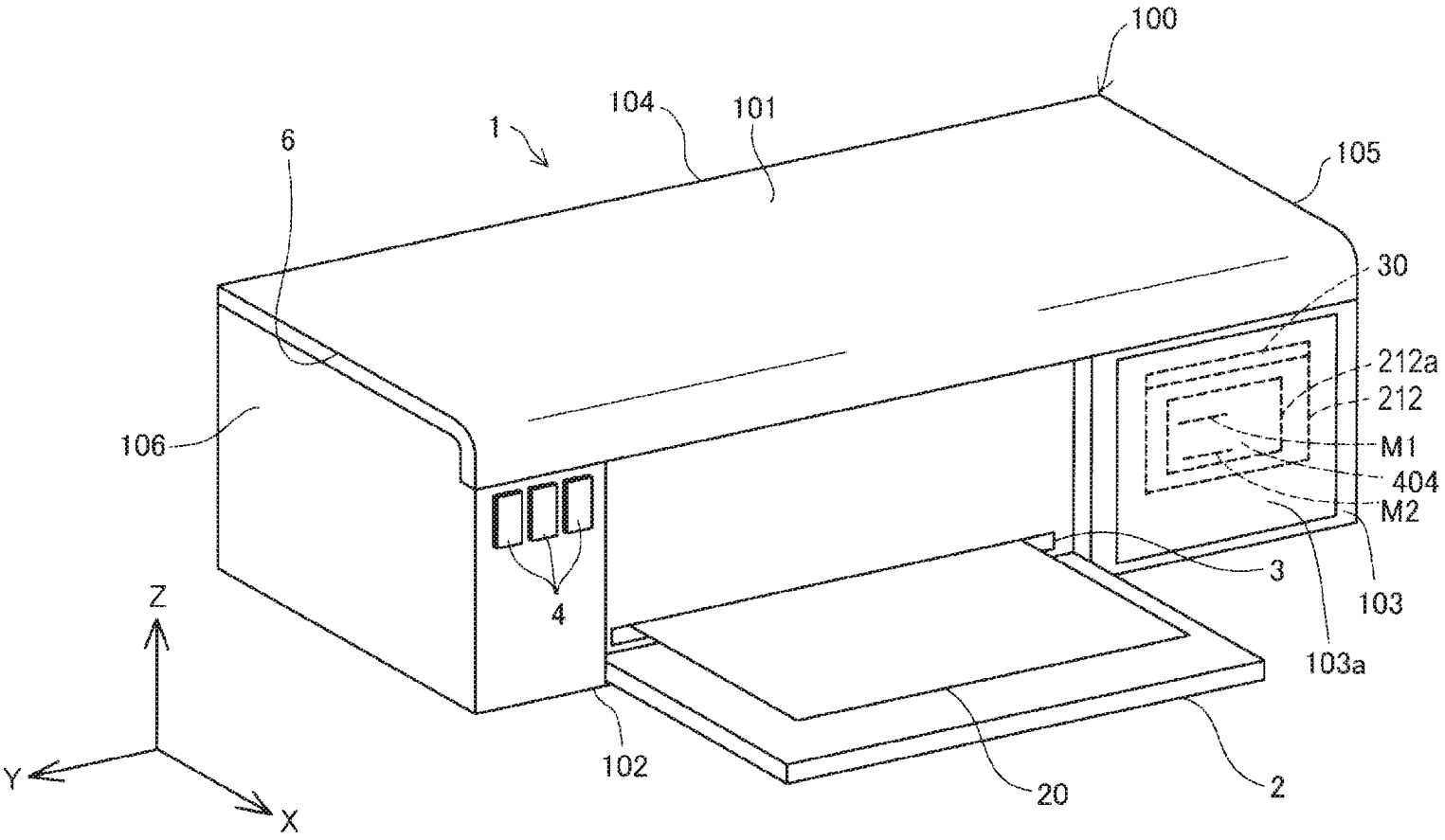
FIG. 1 is an external view showing a configuration of a liquid ejection apparatus according to a first embodiment.

FIG. 1 is an external view showing a configuration of a liquid ejection apparatus 1. FIG. 1 shows three spatial axes orthogonal to each other, namely, an X axis, a Y axis, and a Z axis. In FIG. 1, a direction along the X axis is referred to as an "X axis direction", a direction along the Y axis is referred to as a "Y axis direction", and a direction along the Z axis is referred to as a "Z axis direction" (an up-down direction). The liquid ejection apparatus 1 is installed on a plane parallel to the X axis direction and the Y axis direction (an XY plane). A −Z axis direction is the vertical downward direction, and a +Z axis direction is the vertical upward direction. The X axis, Y axis, and Z axis are added as necessary also to other drawings to be described below.

The liquid ejection apparatus 1 is a so-called inkjet printer, and prints on a recording medium such as paper by ejecting ink as a liquid onto the recording medium. The liquid ejection apparatus 1 of this embodiment is a printer that performs monochrome printing using black ink (also simply referred to as "ink").

The liquid ejection apparatus 1 has an outer shell 100 that forms the outer surface. The outer shell 100 has a substantially rectangular parallelepiped shape, and has an upper face (first face, first wall) 101, a lower face (second face, second wall) 102, a front face (third face, third wall) 103, a rear face (fourth face, fourth wall) 104, a right side face (fifth face, fifth wall) 105, and a left side face (sixth face, sixth wall) 106. The upper face 101 opposes the lower face 102 in the Z axis direction. The front face 103 opposes the rear face 104 in the X axis direction. The right side face 105 opposes the left side face 106 in the Y axis direction. The front face 103, the rear face 104, the right side face 105, and the left side face 106 are faces that are substantially vertical with respect to the installation surface of the liquid ejection apparatus 1 (the XY plane). The upper face 101 and the lower face 102 are faces substantially horizontal with respect to the installation surface of the liquid ejection apparatus 1. Note that in this embodiment, "substantially vertical" and "substantially horizontal" encompass being "approximately vertical" and "approximately horizontal" as well as being "perfectly vertical" and "perfectly horizontal". That is, the faces 101 to 106 are not perfect flat faces, and allow for irregularities and the like, and it suffices for the faces 101 to 106 to appear "approximately vertical" or "approximately horizontal".

The liquid ejection apparatus 1 further has a front face cover 2, a discharge port 3, an operation unit 4, and an upper face cover 6. The front face cover 2 constitutes a portion of the front face 103, is axially supported at the lower end portion of the front face cover 2, and can be opened/closed by pivoting the upper end portion side. In FIG. 1, the front face cover 2 is in an open state. The discharge port 3 is exposed by opening the front face cover 2.

The discharge port 3 is a portion from which a recording medium 20 is discharged. Note that the recording medium 20 may be arranged in a tray provided on the rear face 104 side (not shown). Printing on the recording medium 20 is executed by conveying the recording medium 20 arranged on the tray into the outer shell 100 and ejecting ink onto the recording medium 20.

The operation unit 4 includes buttons that accept various operations from the user. For example, the various operations include an operation of starting printing of the liquid ejection apparatus 1, and the like.

The upper face cover 6 constitutes the upper face 101. The end portion of the upper face cover 6 on the rear face 104 side is axially supported, and the upper face cover 6 can be opened/closed by pivoting the front face 103 side. By opening the upper face cover 6, it is possible to check the internal state of the liquid ejection apparatus 1, perform a mounting/removing operation of the liquid tank 30 serving as the liquid containing body, and replenish (inject) ink into the liquid tank 30.

An apparatus-side window portion 103*a* is formed in a region of the front face 103 overlapping a home position of a carriage 19 in the Y axis direction (the direction of reciprocal movement of the carriage 19 to be described later). In this embodiment, the apparatus-side window portion 103*a* is arranged at a position different from that of the front face cover 2, and is arranged on the −Y axis direction side relative to the front face cover 2. The apparatus-side window portion 103*a* is provided in order to allow the user to view, from the outside, a front face (viewing face) 404 of the liquid tank 30 mounted on the carriage 19 (see FIG. 2) located at the home position. In addition, signs M1 and M2 are provided on the front face 404. The apparatus-side window portion 103*a* may be a through hole that penetrates through the front face 103, or may be a transparent member. The signs M1 and M2 are elements for indicating references for the level of liquid contained in the liquid tank 30, and, in this embodiment, the sign M1 indicates a reference for an upper limit, and the sign M2 indicates a reference for a lower limit. The signs M1 and M2 will be described later in detail. Note that as long as the front face 404 of the liquid tank 30 at the home position can be viewed from the outside, the apparatus-side window portion 103*a* does not need to be provided in the front face 103. For example, the apparatus-side window portion 103*a* may be provided in the upper face 101. In this case, the user can view the front face 404 of the liquid tank 30 by viewing the apparatus-side window portion 103*a* from above and front on.

Figure 2:
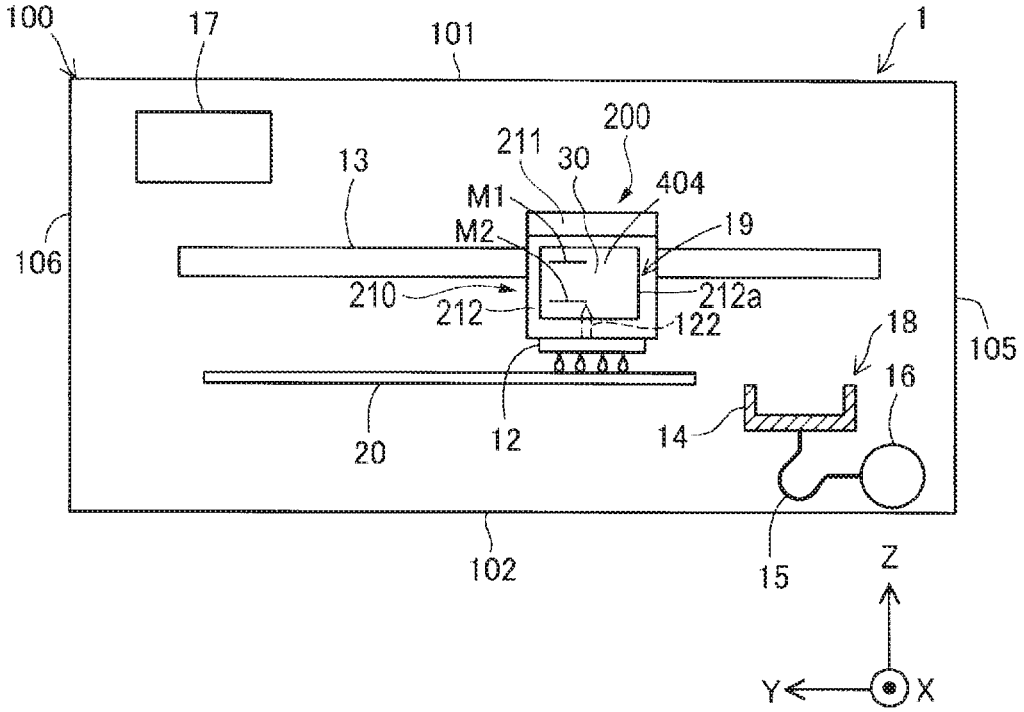
FIG. 2 is a schematic view showing an internal configuration of the liquid ejection apparatus according to the first embodiment.

FIG. 2 is a schematic diagram showing the internal configuration of the liquid ejection apparatus. The liquid ejection apparatus 1 has, inside the outer shell 100, a control unit 17, the carriage 19 provided with a liquid ejection head 12, and a liquid supply unit 200 that is mounted on the carriage 19. The control unit 17 controls various operations (e.g., a printing operation) of the liquid ejection apparatus 1.

The carriage 19 has a housing 210 arranged on the liquid ejection head 12. The housing 210 contains the liquid tank 30 and covers the liquid tank 30. The housing 210 forms a mounting space for mounting the liquid tank 30 on a liquid introduction needle portion 122. The liquid introduction needle portion 122 protruding in the +Z axis direction from a lower face that defines the mounting space protrudes into the housing 210. The liquid introduction needle portion 122 is coupled to the liquid tank 30. The liquid introduction needle portion 122 is hollow, and a communication hole for communication with the inside of the liquid introduction needle portion 122 is formed on the leading end side thereof. Ink supplied from the liquid tank 30 via the communication hole of the liquid introduction needle portion 122 flows inside the liquid introduction needle portion 122. The liquid ejection head 12 has a plurality of nozzles and driving means (e.g., piezoelectric elements) corresponding to the respective nozzles. The liquid ejection head 12 is in communication with the liquid introduction needle portion 122, and ejects ink (in this embodiment, black ink) supplied from the liquid tank 30, from the nozzles onto a recording medium 20 (e.g., printing paper).

In addition, the housing 210 has a mounting portion-side window portion 212*a* for the user to view the front face (viewing face) 404 including the signs M1 and M2. The mounting portion-side window portion 212*a* is provided at at least a position opposed to the signs M1 and M2 of the liquid tank 30. For example, the mounting portion-side window portion 212*a* may be a through hole that penetrates through a wall that forms the housing 210, or may be a transparent member. If the carriage 19 is located at the home position, the user can view the front face 404 (viewing face) with the signs M1 and M2 via the apparatus-side window portion 103*a* (FIG. 1) and the mounting portion-side window portion 212*a*.

The carriage 19 equipped with the liquid ejection head 12 is driven by a driving mechanism (including a driving motor as a driving means), which is not illustrated in the drawings, and repeatedly performs reciprocal movement above the recording medium 20 while being guided by a guide rail 13 extending in the Y axis direction. In addition, the liquid ejection apparatus 1 has a conveyance mechanism (not illustrated) including a conveyance roller for conveying the recording medium 20 toward the discharge port 3 (FIG. 1), a driving motor, and the like. An image or the like is printed onto the recording medium 20 by ejecting liquid from the liquid ejection head 12 in accordance with the movement of the carriage 19 reciprocally moving, and the movement of the recording medium 20 being conveyed.

The liquid tank 30 contains ink to be supplied to the liquid ejection head 12. The ink according to the present embodiment is black ink, and is ink obtained by dissolving pigment particles in a solvent. The liquid tank 30 is detachably coupled to the liquid introduction needle portion 122. Due to the liquid tank 30 being coupled to the liquid introduction needle portion 122, the ink in the liquid tank 30 can flow in the liquid introduction needle portion 122. A material that can demonstrate an affinity with the properties of the contained ink and a function required of the ink tank 30 may be selected as the material of the ink tank 30.

The liquid ejection apparatus 1 further has a discharge portion 18 that executes an operation (discharging operation) of periodically sucking out a fluid (e.g., liquid (ink) or air) from the liquid ejection head 12.

The discharge portion 18 is arranged inside the outer shell 100. The discharge portion 18 includes a cap 14, a suction tube 15, and a suction pump 16. When the liquid ejection apparatus 1 is not performing a printing operation, the carriage 19 is arranged at the home position, which is a position that is outside of a movement region for a printing operation.

The cap 14 is a member arranged below the home position and shaped like a bottomed box. The cap 14 can be moved in the Z axis direction (the vertical direction (the up-down direction)) by a driving motor serving as the driving means. The cap 14 is pressed against the lower face of the liquid ejection head 12 by being moving upward. Accordingly, the cap 14 forms a closed space such that nozzles formed in the lower face of the liquid ejection head 12 are covered. That is, a closed space state is formed due to the cap 14 capping the nozzles of the liquid ejection head 12 so as to cover the nozzles. It is possible to suppress the drying of ink in the liquid ejection head 12 (nozzles) by using this closed space.

The suction tube 15 allows the cap 14 (specifically, a through hole formed in the bottom face of the cap 14) and the suction pump 16 to be in communication with each other. The suction pump 16 sucks fluid (liquid (ink) or air) in the liquid ejection head 12 or the liquid tank 30 via the suction tube 15 by being driven in the closed space state. Initial filling of the liquid ejection head 12 with ink can be performed in this manner, and deteriorated ink (dried and thickened ink) in the liquid ejection head 12 can be sucked out.

Next, a detailed configuration of the liquid supply unit 200 will be described.

Figure 3:
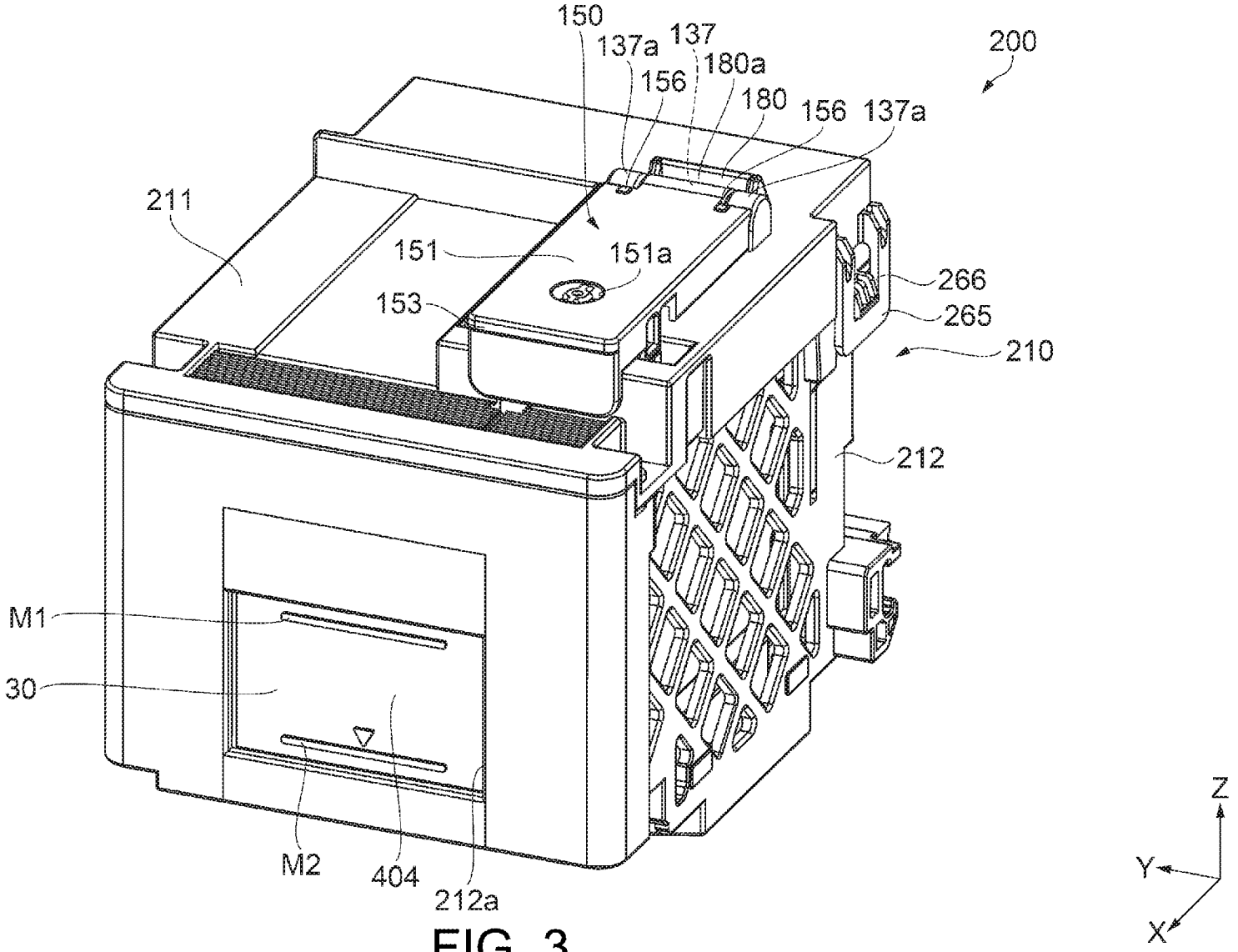
FIG. 3 is a perspective view showing a configuration of a liquid supply unit according to the first embodiment.
Figure 4:
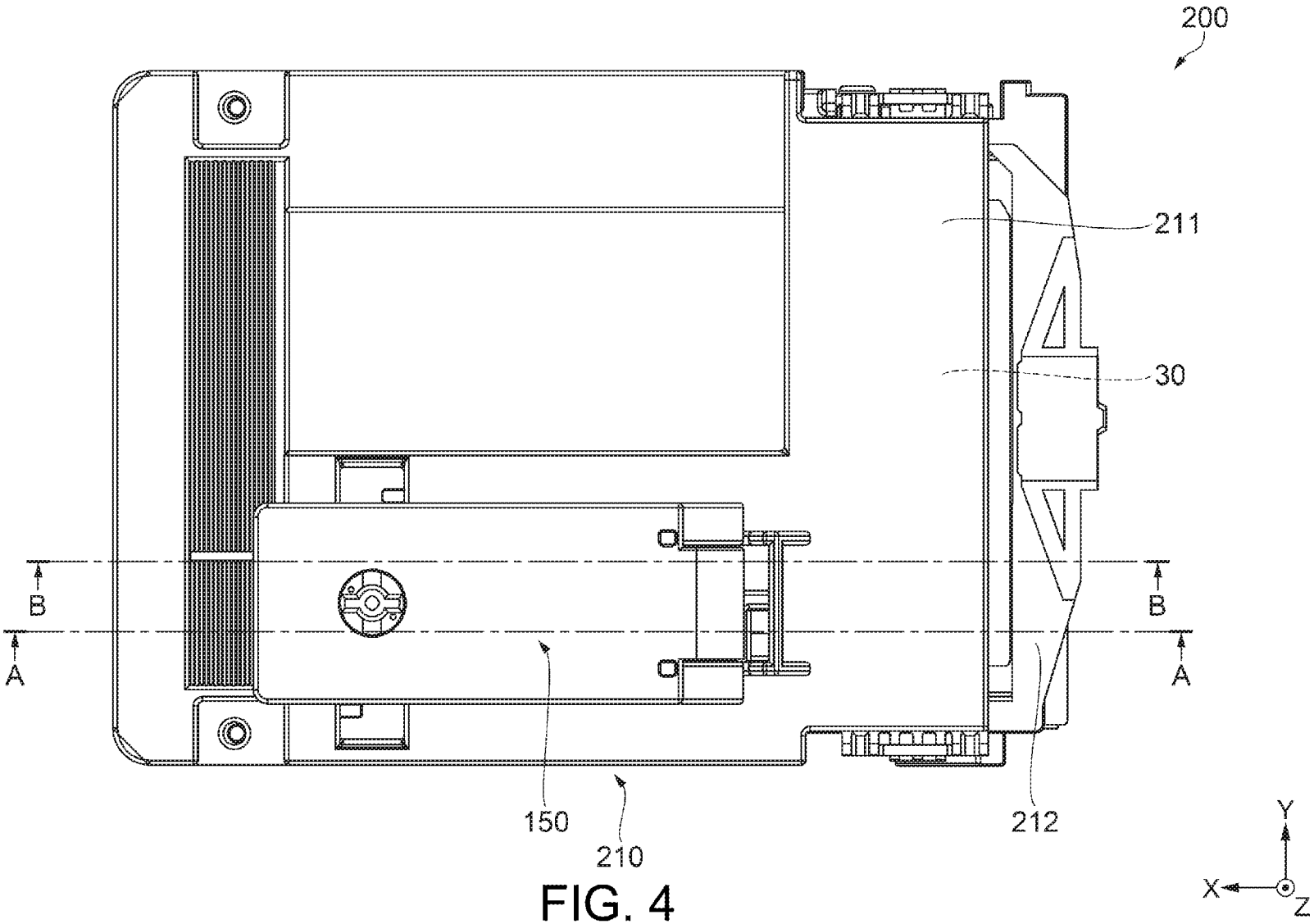
FIG. 4 is a plan view showing a configuration of the liquid supply unit according to the first embodiment.
Figure 5:
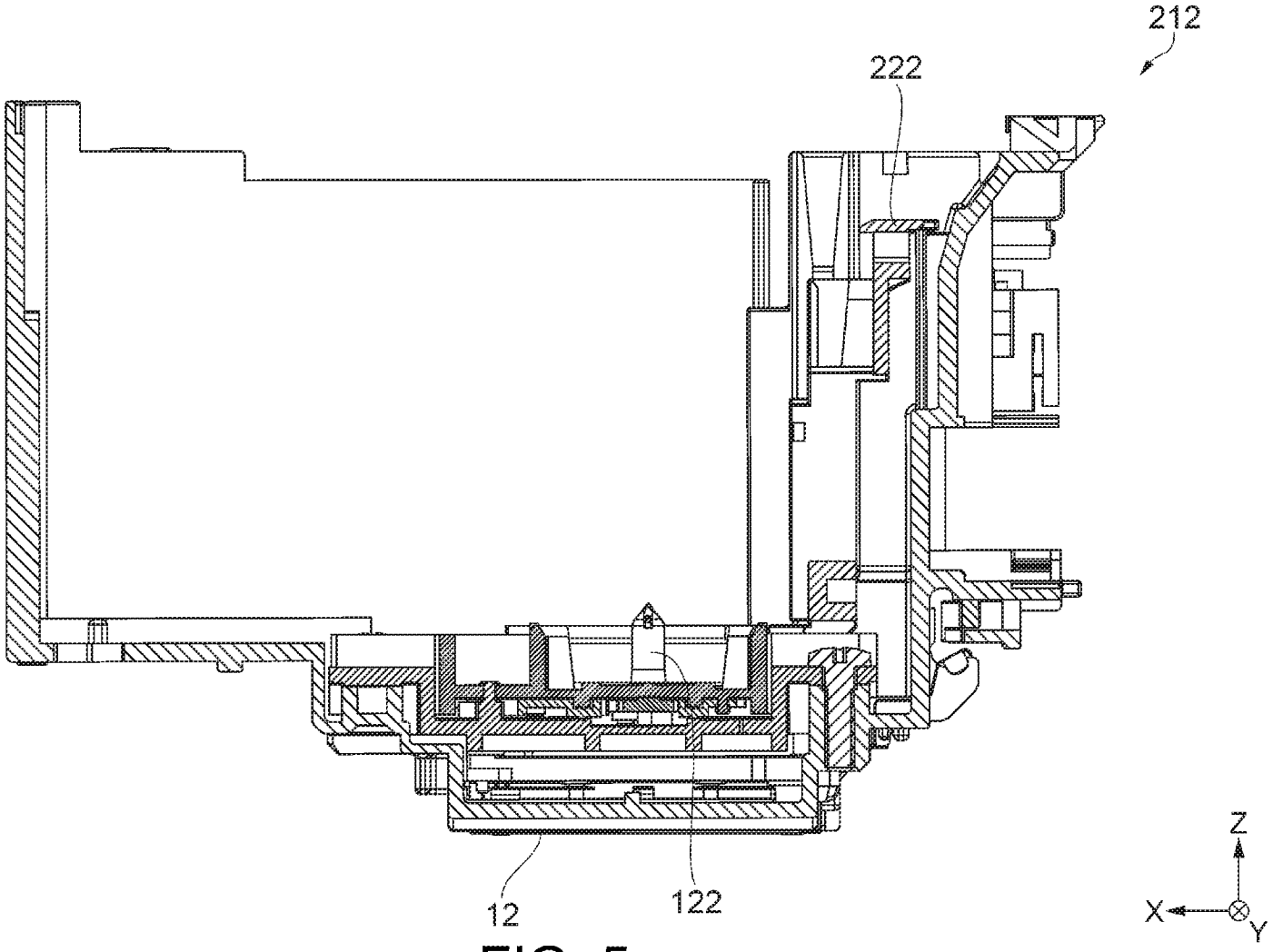
FIG. 5 is a cross-sectional view showing a configuration of a second housing according to the first embodiment.
Figure 6:
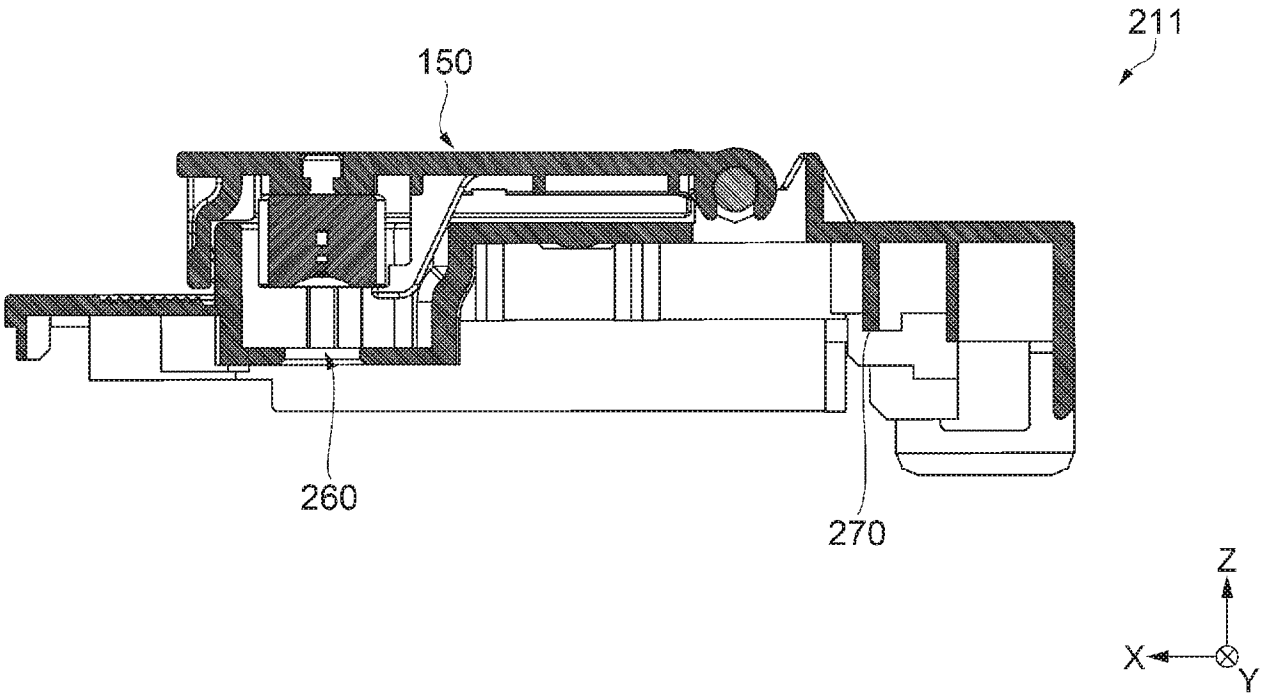
FIG. 6 is a cross-sectional view showing a configuration of a first housing according to the first embodiment.
Figure 7:
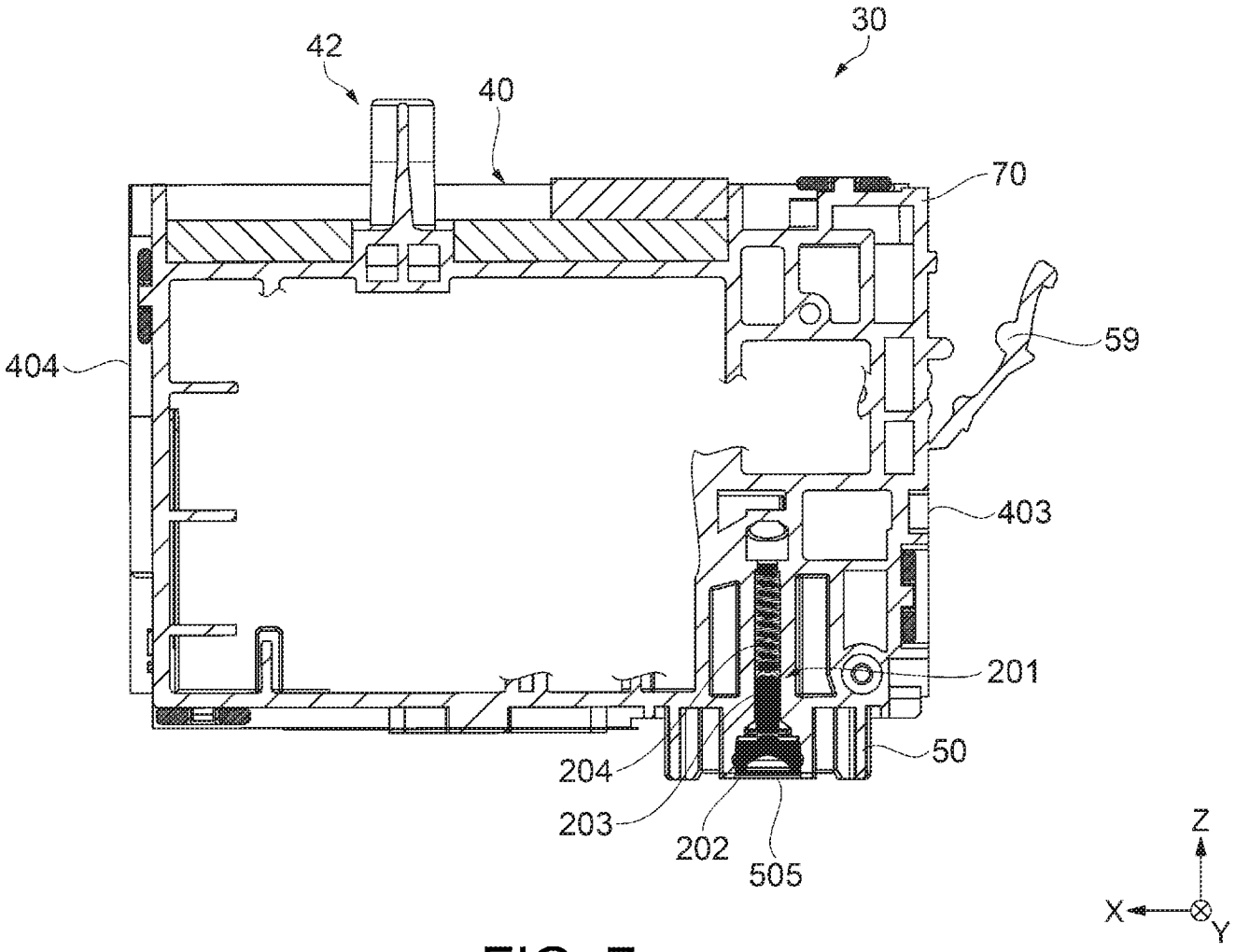
FIG. 7 is a cross-sectional view showing a configuration of a liquid tank according to the first embodiment.

FIG. 3 is a perspective view showing a configuration of a liquid supply unit, and FIG. 4 is a plan view showing a configuration of a liquid supply unit. Also, FIG. 5 is a cross-sectional view showing a configuration of a second housing, and is a cross-section taken along line A-A in FIG. 4. FIG. 6 is a cross-sectional view showing a configuration of a first housing, and is a cross-section taken along line A-A in FIG. 4. Also, FIG. 7 is a cross-sectional view showing a configuration of a liquid tank, and is a cross-section taken along line A-A in FIG. 4. Note that a state is shown in which the liquid tank shown in FIG. 7 has been taken out of the housing 210 in FIG. 3.

Figure 8:
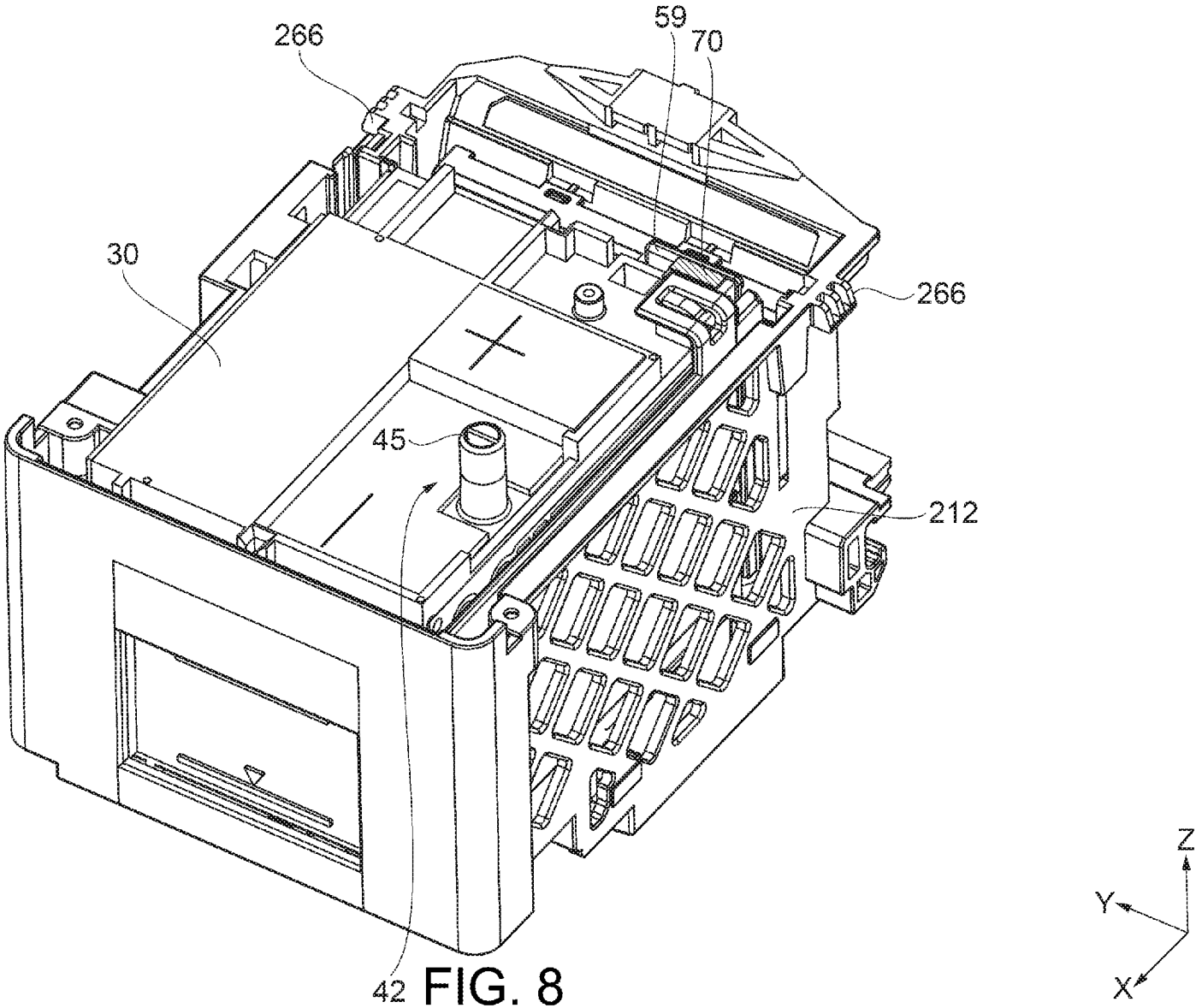
FIG. 8 is a perspective view showing a partial configuration of the liquid supply unit according to the first embodiment.

Also, FIG. 8 is a perspective view showing a partial configuration of a liquid supply unit, and shows a state in which the first housing 211 has been removed from the liquid supply unit 200 shown in FIG. 3. That is, a state is shown in which the liquid tank 30 is contained in the second housing 212.

Figure 9:
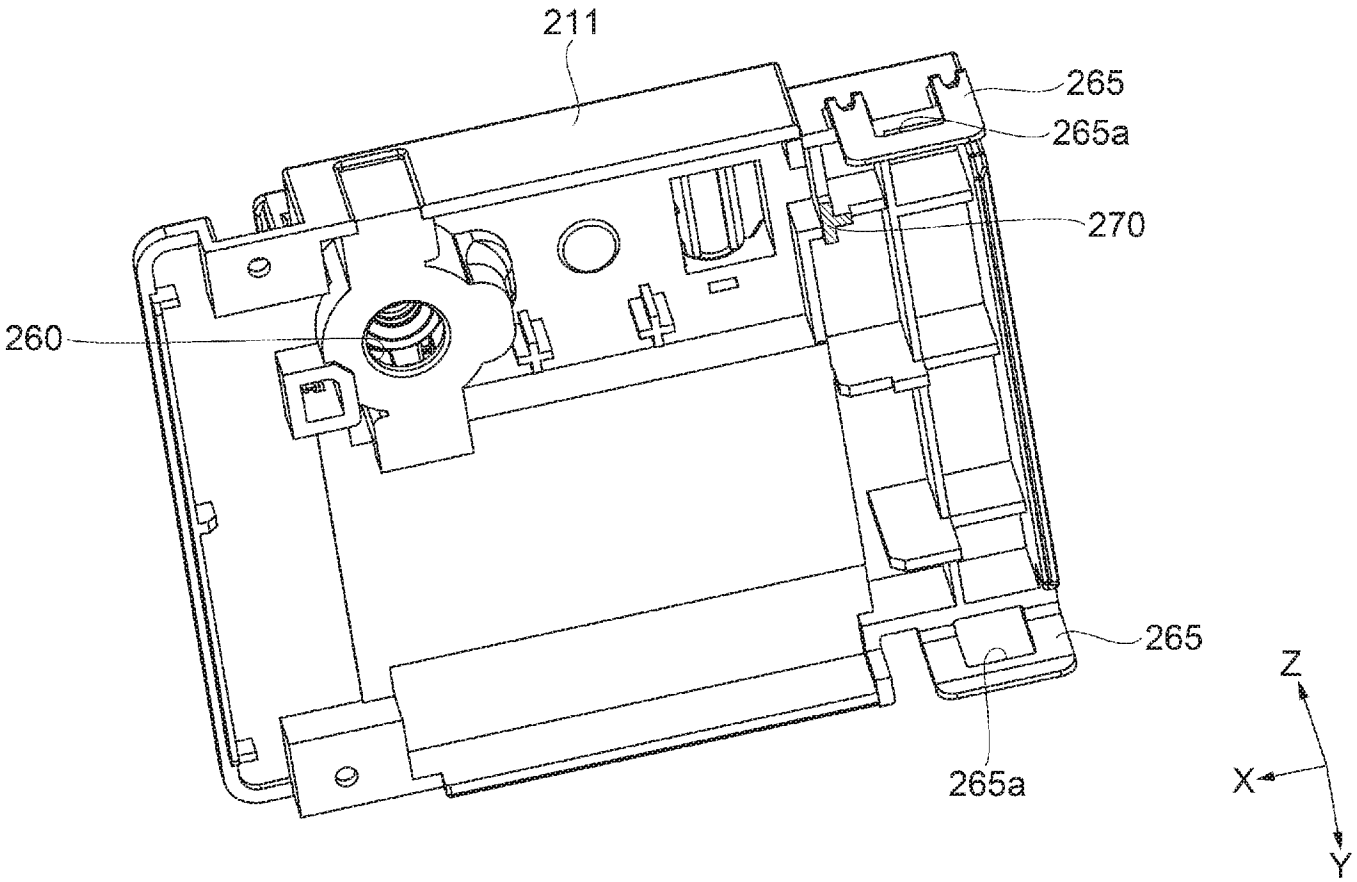
FIG. 9 is a perspective view showing a configuration of the first housing according to the first embodiment.
Figure 10:
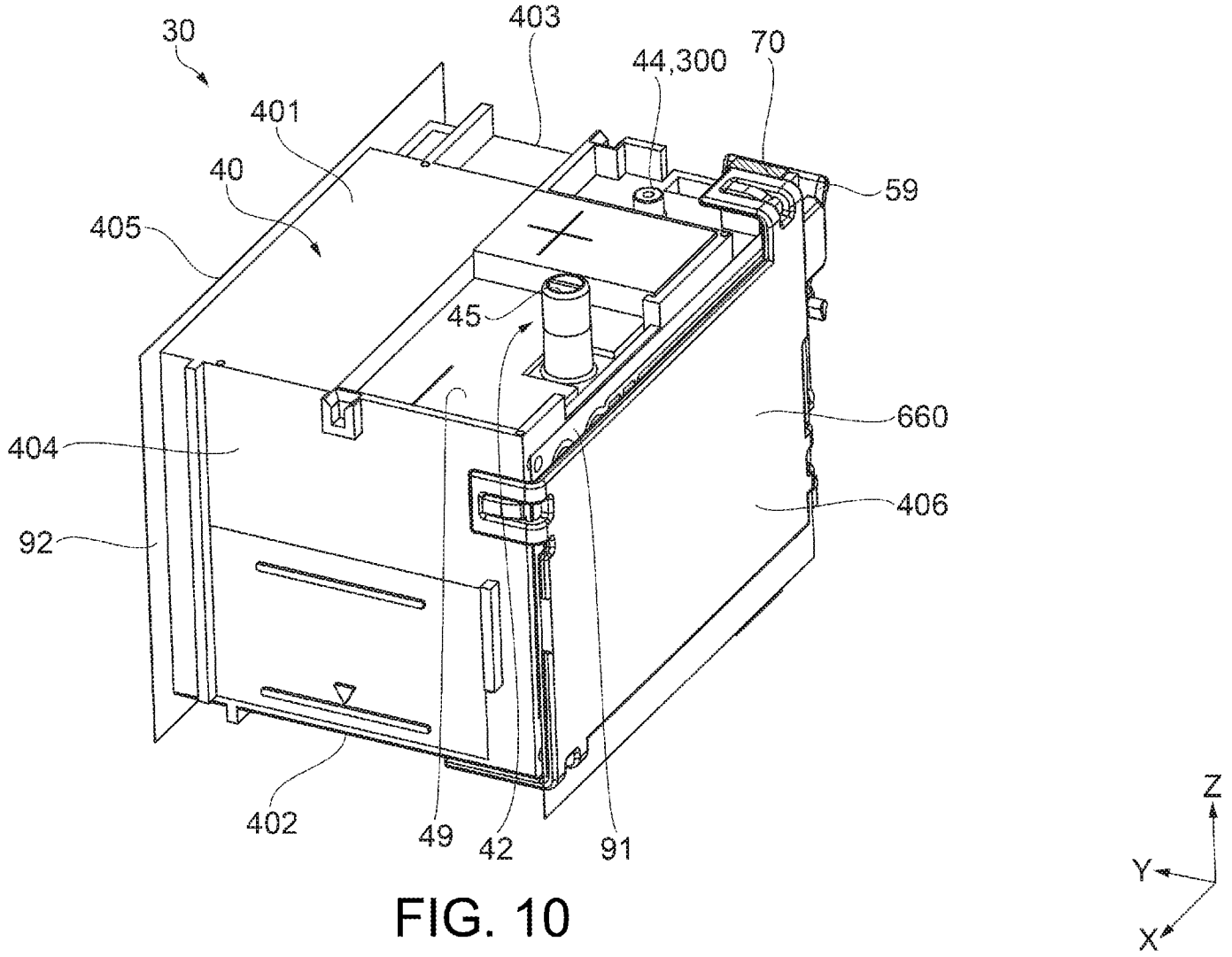
FIG. 10 is a perspective view showing an exterior of a liquid tank according to the first embodiment.

Also, FIG. 9 is a perspective view showing a configuration of a first housing, and shows a state in which the first housing 211 is viewed from the liquid tank 30 side. Also, FIG. 10 is a perspective view showing an exterior of a liquid tank.

The liquid supply unit 200 supplies ink to the liquid ejection head 12 of the liquid ejection apparatus 1. As shown in FIGS. 3 and 4, the liquid supply unit 200 includes: a liquid tank 30; a housing 210; and a plug member 150.

The liquid tank 30 is a container configured to be able to contain ink. The housing 210 covers the liquid tank 30. The housing 210 according to the present embodiment includes: a first housing 211 that covers the liquid tank 30 from one direction on a mounting axis; and a second housing 212 that opposes the first housing 211. Note that the mounting axis is the axis along which the first housing 211 is moved in order to mount it on the liquid tank 30 contained in the second housing 212. In the present embodiment, it is the −Z axis direction.

As shown in FIGS. 6 and 9, the first housing 211 has a lid shape and includes a through hole 260 through which the liquid injection portion 42 (see FIG. 8) of the liquid tank 30 is to be passed. Also, the first housing 211 has claw portions 265 for engaging with the second housing 212. The claw portions 265 are at the −X axis end portion of the first housing 211, and are provided on both end portions in the Y axis direction. Also, an opening 265*a* is provided in each claw portion 265. Note that the claw portions 265 can elastically deform.

Also, as shown in FIG. 8, hooks 266, which are at the −X axis end portion of the second housing 212 and engage with the claw portions 265, are provided on both end portions in the Y axis direction. The user presses the first housing 211 against the second housing 212 while causing the claw portions 265 to elastically deform following the outer surfaces of the hooks 266. Then, when the hooks 266 are fit into the openings 265*a* of the claw portions 265, the elastic deformation of the claw portions 265 returns to normal. Accordingly, the first housing 211 and the second housing 212 are engaged.

Also, as shown in FIG. 5, the second housing has a recessed shape that is open in the +Z axis direction, and is provided with the mounting space in which the liquid tank 30 is mounted. Also, the second housing 212 is provided with the liquid introduction needle portion 122 that protrudes in the +Z axis direction from the lower surface defining the mounting space. The liquid supply unit 200 is configured such that the liquid tank 30, the first housing 211, and the second housing 212 can be removed.

Also, the second housing 212 is provided with a second positioning portion 222 that engages with the first positioning portion 59 (see FIG. 7) provided on the liquid tank 30.

As shown in FIGS. 7 and 10, the liquid tank 30 includes: a tank main body 40; a first film 91; and a second film 92. The liquid tank 30 has an approximately rectangular parallelepiped shape. In the liquid tank 30, the X axis direction is the length direction, the Y axis direction is the width direction, and the Z axis direction is the height direction.

The liquid tank 30 includes: an upper face (first face, first wall) 401, a lower face (second face, second wall) 402, a rear face (third face, third wall) 403, a front face (fourth face, fourth wall) 404, a left side face (fifth face, fifth wall) 405, and a right side face (sixth face, sixth wall) 406. In a mounted state in which the liquid tank 30 is mounted in the second housing 212 (carriage 19), the upper face 401 and the lower face 402 oppose each other in the Z axis direction. In the mounted state, the rear face 403 and the front face 404 oppose each other in the X axis direction. In the mounted state, the left side face 405 and the right side face 406 oppose each other in the Y axis direction. The left side face 405 is formed by the second film 92. The right side face 406 is formed by the first film 91. The upper face 401, the lower face 402, the rear face 403, and the front face 404 are formed by the tank main body 40. The rear face 403, the front face 404, the left side face 405, and the right side face 406 are faces substantially vertical with respect to the installation surface of the liquid ejection apparatus 1. The upper face 404 and the lower face 102 are faces substantially horizontal with respect to the installation surface of the liquid ejection apparatus 1. That is, the faces 401 to 406 are not perfect flat faces, and allow for irregularities and the like, and it suffices for the faces 401 to 406 to appear "approximately vertical" or "approximately horizontal". Also, the front face 404 constitutes a viewing face through which the level of the ink in the liquid tank 30 can be viewed from the outside. For example, the front face 404 (viewing face) is formed by a transparent or semi-transparent member (resin member). The front face 404 may be provided with signs (e.g., graduations or marks) that correspond to references (e.g., an upper limit and a lower limit) for the level of the ink. In the present embodiment, the front face 404 is provided with an upper limit sign M1, which is a sign corresponding to the upper limit, and a lower limit sign M2, which is a sign corresponding to the lower limit. For example, when the ink is to be injected through the liquid injection portion 42, if the liquid surface has reached the upper limit sign M1, the user stops the injection of the ink. Alternatively, the ink injection container itself, such as a bottle, may automatically stop the injection. Also, for example, when the liquid surface of the liquid tank reaches the lower limit sign M2, the user injects the ink into the interior of the liquid tank 30 through the liquid insertion portion 42.

The rear face 403 is provided with a first positioning portion 59 that performs positioning on the mounting axis when the liquid tank 30 is to be mounted in the second housing 212 (carriage 19). The first positioning portion 59 has a lever shape and can elastically deform, and in the state of being mounted on the second housing 212, the liquid tank 30 is locked to the second housing 212 by engaging with the second positioning portion 222 (see FIG. 5) of the second housing 212, and thus is prevented from coming off of the second housing 212.

For example, the tank main body 40 is formed using synthetic resin such as polypropylene or polystyrene. The first film 91 and the second film 92 are airtightly adhered to different portions of the tank main body 40, whereby a flow path through which the ink and air in the liquid tank 30 flow is defined and formed along with the tank main body 40.

Also, the tank main body 40 includes a liquid insertion portion 42 through which ink can be inserted into the liquid tank 30. The liquid insertion portion 42 extends in the +Z axis direction from the bottom face 49 of the corner portion at which the upper face 401, the front face 404, and the right side face 406 intersect. The liquid insertion portion 42 is a tube-shaped member and forms the first flow path and the second flow path. A partitioning wall 45 is arranged inside the liquid insertion portion 42. The first flow path and the second flow path are partitioned by the partitioning wall 45. During injection of the ink, the first flow path functions as a liquid insertion path by which the ink flows into the liquid tank 30, and the second flow path functions as an air discharge path by which air is discharged from inside the liquid tank 30. The liquid insertion portion 42 is sealed by the plug member 150 when the ink in the ink tank 30 is used. Also, an atmosphere release portion 44, which is one end portion of an atmosphere communication portion 300, is formed in the upper portion of the tank main body 40. The atmosphere communication portion 300 has a thin groove-shaped flow path, and a buffer chamber that can contain ink when ink flows backward. The other end portion of the atmosphere communication portion 300 is coupled to the inside of the liquid tank 30.

Also, as shown in FIG. 7, the tank main body 40 includes a liquid supply portion 50 that supplies the ink inside of the liquid tank 30 to the liquid ejection head 12. The liquid supply unit 50 has a liquid supply port 505.

Also, a supply portion valve mechanism 201 for opening and closing the flow path of the liquid supply unit 50 is arranged inside of the liquid supply portion 50. The supply portion valve mechanism 201 includes, in order starting from downstream: a valve seat 202, a valve body 203, and a spring 204. The valve seat 202 is a substantially circular ring-shaped member. The valve seat 202 is constituted by an elastic member such as rubber or an elastomer, for example. The valve seat 202 is press-fit into the liquid supply portion 50. The valve body 202 is a substantially circular column-shaped member. The valve body 203 closes a hole (valve hole) formed in the valve seat 202 in a state (unattached state) in which the liquid tank 30 has not yet been mounted on the second housing 212 (carriage 19). The spring 204 is a compressed coil spring. The spring 204 biases the valve body 203 in the direction toward the valve seat 202. In the mounted state of the liquid tank 30, in which the liquid tank 30 is mounted on the second housing 202 (carriage 19) and the liquid supply portion 50 is coupled to the liquid introduction needle portion 122, the valve body 203 moves away from the valve seat 202 due to the liquid introduction needle portion 122 pressing the valve body 203 upstream. Accordingly, the supply portion valve mechanism 201 enters the open state, and ink can be supplied to the liquid ejection head 12 via the liquid introduction needle portion 122 from the liquid supply port 505 of the liquid supply portion 50.

Also, as shown in FIG. 10, the liquid tank 30 of the present embodiment includes a tank cover 660 that can come into contact with the first film 91 and covers the first film 91. The tank cover 660 has a flat shape, and for example, is made of various metal materials, a plastic material, or the like. Note that the method for attaching the tank cover 660 is not particularly limited, and for example, the tank cover 660 is attached to the wall of the liquid tank 30 using screws, hooks, adhesion, or the like. Even if the environment in which the liquid tank 30 is used (temperature, air pressure, etc.) changes, a stable operation pressure can be ensured by installing the tank cover 660. Also, separation of the first film 91 from the tank main body 40 can be prevented, and liquid leakage can be prevented.

Here, when attaching the liquid tank 30 to the second housing 212, for example, if the pressure of the liquid tank 30 on the second housing 212 is insufficient, a case is conceivable in which the second positioning portion 222 of the second housing 212 and the first positioning portion 59 of the liquid tank 30 do not transition reliably to the locked state. In this case, the state of engagement between the liquid supply port 505 and the liquid introduction needle portion 122 of the liquid tank 30 will be insufficient, and therefore ink can no longer be reliably supplied from the liquid tank 30 to the liquid ejection head 12, and there is a risk that the ink will leak from the portion at which the liquid supply port 505 and the liquid introduction needle portion 122 are engaged.

In view of this, the liquid supply unit 200 of the present embodiment has a configuration according to which the liquid tank 30 and the second housing 212 can be reliably locked, or in other words, a configuration according to which the liquid supply port 505 and the liquid introduction needle portion 122 can be reliably engaged.

Specifically, as shown in FIG. 8, a pressed portion 70 is provided on the upper face 401 of the liquid tank 30. On the other hand, as shown in FIG. 9, a pressing portion 270 is provided at a portion corresponding to the pressed portion 70, which is on the face of the first housing 211 that opposes the pressed portion 70 of the liquid tank 30. The pressing portion 270 presses the pressed portion 70 in one direction on the mounting axis. In the present embodiment, the faces at which the pressing portion 270 and the pressed portion 70 come into contact have planar surfaces. Note that in FIGS. 8 and 9, in order to simplify the description, the contact surfaces of the pressing portion 270 and the pressed portion 70 are indicated with hatching.

Note that the pressing portion 270 and the pressed portion 70 may be arranged directly above the liquid introduction needle portion 122. In this case, the pressing caused by the pressed portion 70 being pressed by the pressing portion 270 is transmitted in a concentrated manner near the liquid supply port 505, and therefore the liquid supply port 505 and the liquid introduction needle portion 122 can be engaged efficiently.

Next, a method for assembling the liquid supply unit 200 will be described.

Figure 11:
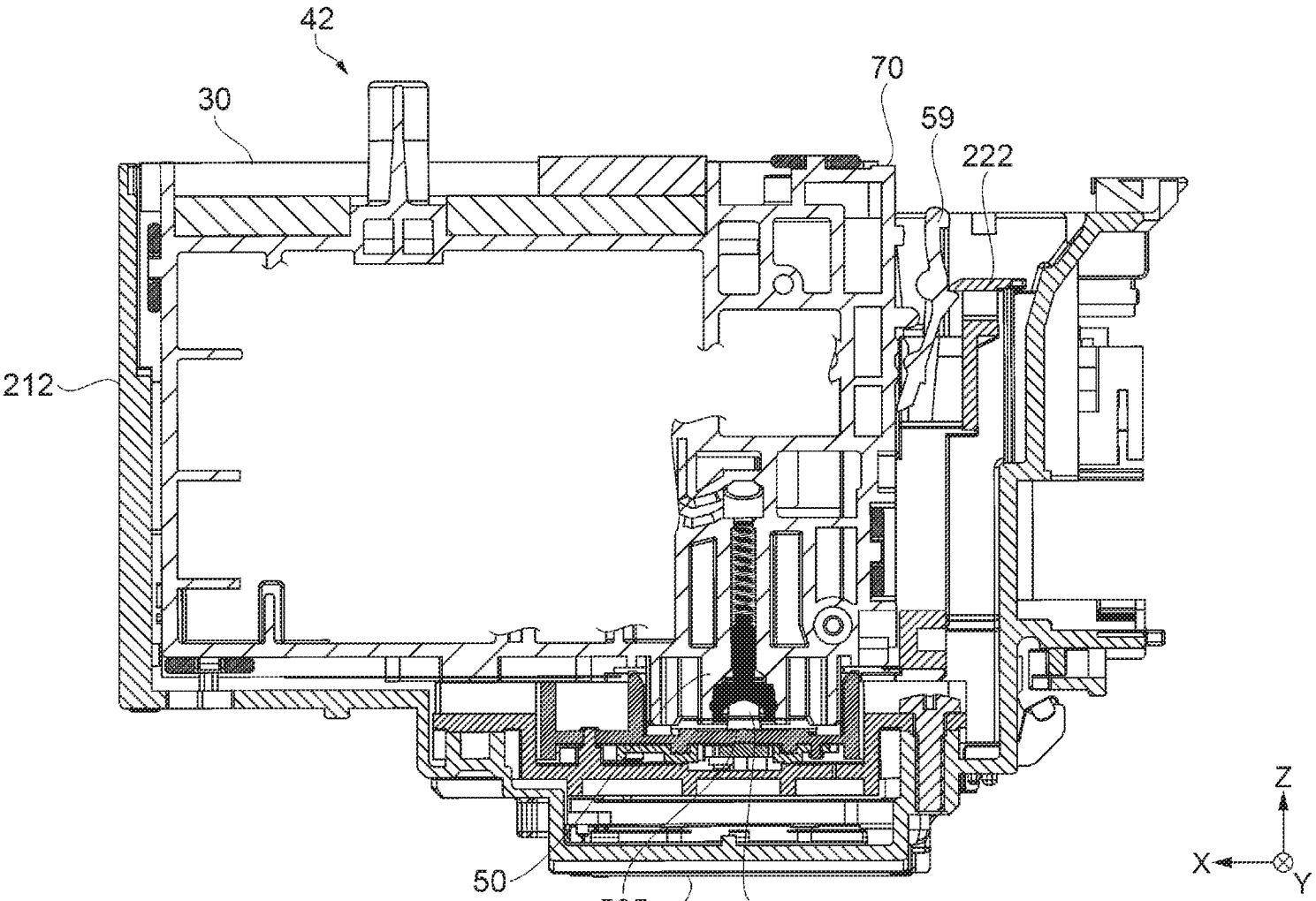
FIG. 11 is an illustrative view showing a method for assembling the liquid supply unit according to the first embodiment.
Figure 12:
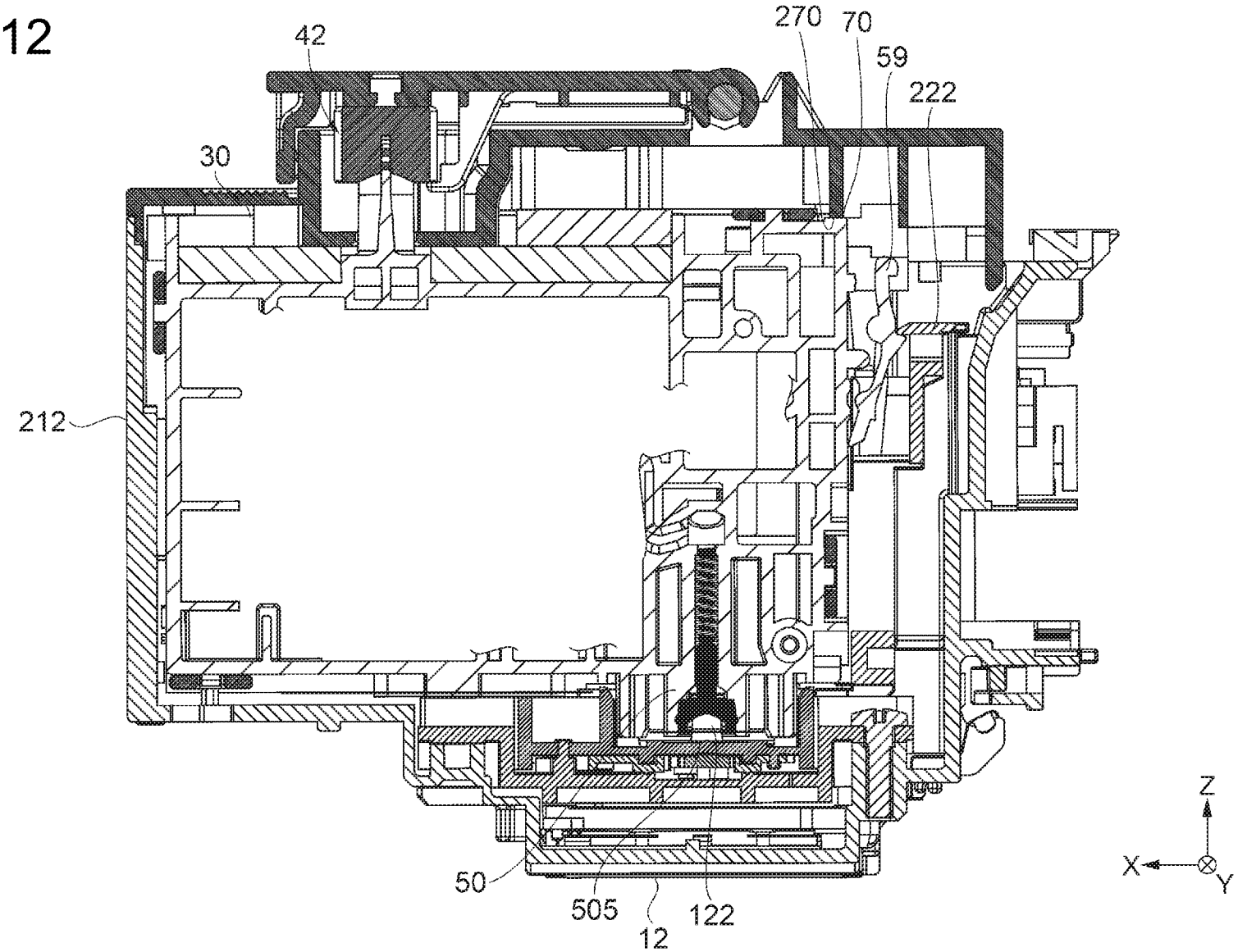
FIG. 12 is an illustrative view showing a method for assembling the liquid supply unit according to the first embodiment.

FIGS. 11 and 12 are illustrative diagrams showing a method for assembling a liquid supply unit.

First, as shown in FIG. 11, the liquid tank 30 is pressed into the second housing 212 in the mounting direction (−Z direction).

Accordingly, the first positioning portion 59 moves in the mounting direction with respect to the second positioning portion 222 while elastically deforming. Then, at a certain portion, the elastic deformation of the first positioning portion 59 is canceled, and the second positioning portion 222 and the first positioning portion 59 engage.

Next, as shown in FIG. 12, the first housing 211 is pressed in the mounting direction (−Z direction) into the second housing 212 in which the liquid tank 30 is contained. At this time, the pressed portion 70 is pressed by the pressing portion 270. Then, the first positioning portion 59 locks onto the second positioning portion 222 in conjunction with the pressing. That is, even if the state in which the first positioning portion 59 and the second positioning portion 222 are locked is insufficient when the liquid tank 30 is contained in the second housing 212, thereafter, when the first housing 211 is attached to the second housing, the liquid tank 30 is pressed in the −Z axis direction via the pressed portion 70, and therefore the first positioning portion 59 is locked onto the second positioning portion 222. Accordingly, the liquid supply port 505 of the liquid tank 30 and the liquid introduction needle portion 122 are reliably engaged. Also, the claw portions 265 and the hooks 266 are engaged.

Accordingly, the ink can be reliably supplied from the liquid tank 30 to the liquid ejection head 12, and leakage of the ink from the portion at which the liquid supply port 505 and the liquid introduction needle portion 122 are engaged can be prevented.

Note that the liquid insertion portion 42 protruding upward from the through hole 260 of the first housing 211 can be locked by the plug member 150 due to the first housing 211 being attached to the second housing 212 in which the liquid tank 30 is contained.

Next, the configuration of the plug member 150 will be described.

Figure 13:
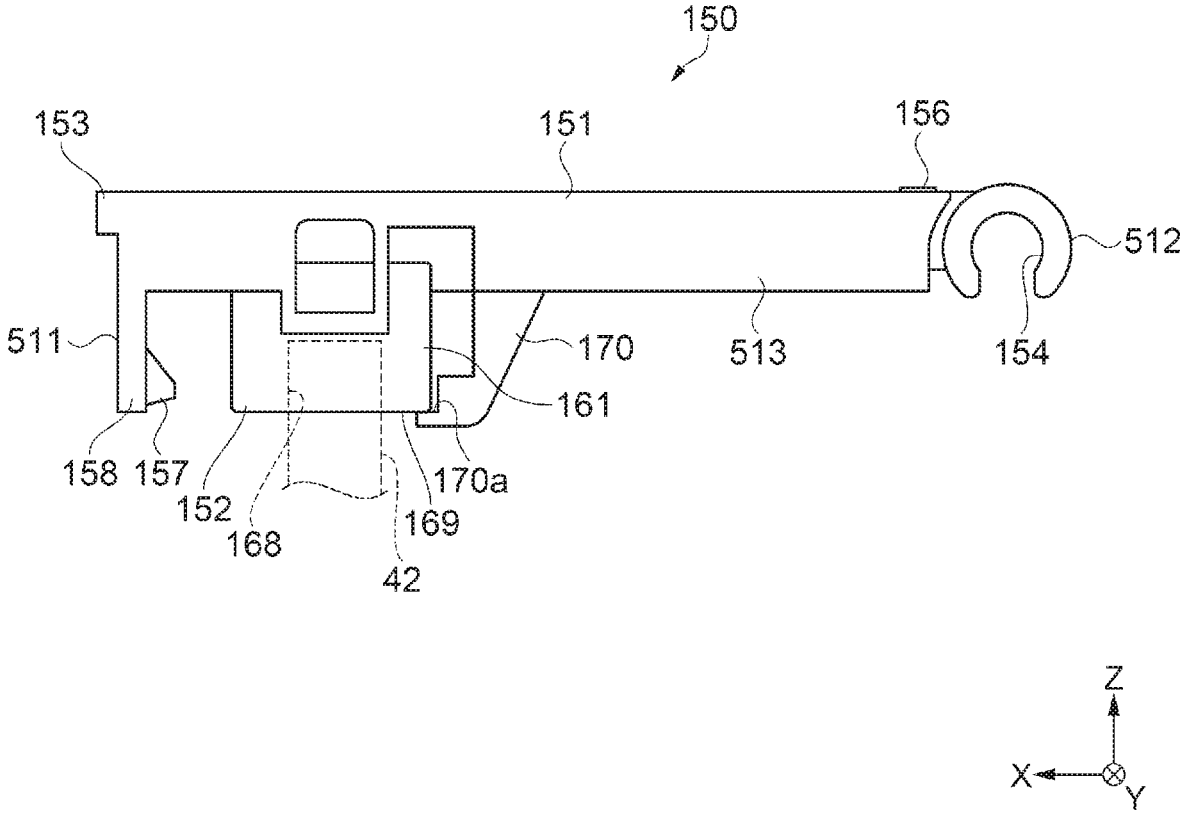
FIG. 13 is a side view showing a configuration of a plug member according to the first embodiment.
Figure 14:
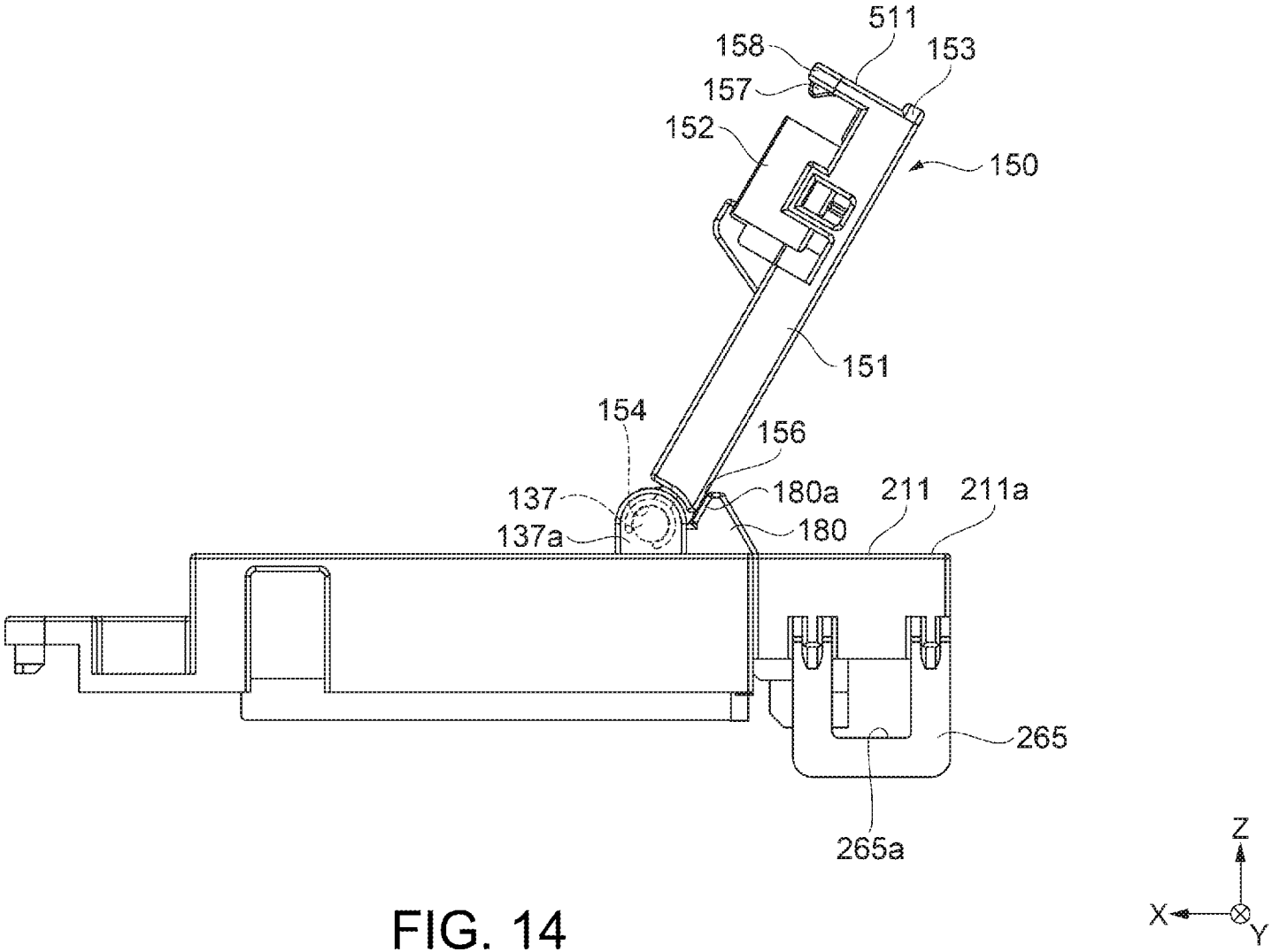
FIG. 14 is a side view showing a state in which the plug member is attached to the first housing according to the first embodiment.

FIG. 13 is a side view showing a configuration of the plug member. FIG. 14 is a side view showing a state in which the plug member is attached to the first housing.

The plug member 150 is lever-shaped and is configured to be able to seal the liquid injection portion 42. Specifically, as shown in FIG. 13, the plug member 150 includes a plug main body 152 that covers the liquid injection portion 42; and a holding member 151 that holds the plug main body 152. The holding member 151 has an elongated shape that is elongated in one direction. The holding member 151 includes one end 511, another end 512, and a side end 513 that intersects with the one end 511 and the other end 512. In the example shown in FIG. 13, the holding member 151 has an approximately rectangular plate shape that is elongated in one direction, and includes the one end 511, the other end 512, and two side ends 513 having end faces that intersect with both the end face of the first end 511 and the end face of the other end 512.

A gripping portion 153 to be gripped by the user is provided on the one end 511 of the holding member 151. The gripping portion 153 is an end portion above the one end 511 (in the +Z axis direction) and protrudes toward the one end 511 (in the +X axis direction) from the other end 512 of the holding member 151.

Also, the other end 512 of the holding member 151 is provided with a first pivoting portion 154 that is configured to pivot the plug member 150. As shown in FIG. 14, the first pivoting portion 154 is fit over a second pivoting portion 137 provided on the upper surface of the first housing 211.

The first pivoting portion 154 has a C-shaped cross-section, which is obtained by cutting part of a ring. Also, the second pivoting portion 137 has a circular column-shaped shaft portion. Also, the first pivoting portion 154 and the second pivoting portion 137 are engaged by pressing the opening portion of the first pivoting portion 154 against the second pivoting portion 137. Accordingly, the first pivoting portion 154 can pivot about the axis of the second pivoting portion 137.

Note that support portions 137*a*, which are larger than the diameter of the shaft portion, are formed at both ends in the Y direction of the shaft portion in the first pivoting portion 137. Accordingly, the first pivoting portion 154 is restricted from being misaligned in the Y axis direction when engaged with the second pivoting portion 137.

The plug member 152 is arranged at a position between the gripping portion 153 at one end and the first pivoting portion 154 at the other end in the holding member 151. Since the user can open and close the plug member by gripping, with fingers, the gripping portion 153 located on the one end 511 side of the holding member 151 with respect to the plug member 152, ink stuck to the plug member 152 is less likely to stick to the fingers.

Also, as shown in FIG. 14, the first housing 211 is provided with a third protrusion 180 that restricts and locks pivoting of the plug member 150 by coming into contact with the end portion on the first pivoting portion 154 side of the plug member 150 when the plug member 150 pivots away from the liquid injection portion 42 during an opening/closing operation of the plug member 150. The third protrusion 180 is arranged in the −X axis direction relative to the first pivoting portion 154 and the second pivoting portion 137. The third protrusion 180 has an inclined surface 180*a* that comes into contact with an end portion (part of the holding member 151) of the first pivoting portion 154 on the +X axis direction side of the third protrusion 180. The angle formed by the inclined surface 180*a* of the third protrusion 180 and the upper face 211*a* of the first housing 211 is approximately 60 degrees. Accordingly, the angle of motion of the plug member 150 when the plug member 150 is pivoted away from the liquid injection port 42 is, at most, approximately 120 degrees. That is, the pivoting of the plug member 150 is restricted by the third protrusion 180 at a position at which the plug member 150 has been pivoted approximately 120 degrees away from the liquid injection portion 42. Accordingly, it is possible to reliably recognize that the plug member 150 has been locked at a predetermined position. Also, in the state in which the plug member 150 is locked by the third protrusion 180, the gripping portion 153 is located upward (in the +Z direction), and therefore a finger can easily be placed on the gripping portion 153 when the plug member 150 is to be closed, and handling of the plug member 150 can be facilitated.

Also, in the present embodiment, as shown in FIGS. 13 and 14, fourth protrusions 156 are provided at the portions of the plug member 150 that come into contact with the inclined surface 180*a* of the third protrusion 180, that is, near the first pivoting portion 154 (part of the holding member 151).

The fourth protrusions 156 are formed on the end portions in the Y axis direction of the holding member 151. The positions of the two fourth protrusions 156 correspond to positions of coming into contact with the two end portions in the Y axis direction of the inclined face 180*a*. Also, when the plug member 150 is locked by the third protrusion 180, the inclined face 180*a* of the third protrusion 180 and the fourth protrusion 156 come into contact. Accordingly, scratches and the like caused by contact between the holding member 151 and the third protrusion 180 can be made less likely to occur.

The holding member 151 is composed of a non-flexible member. Examples of the non-flexible member include plastic and metal. The plug member 152 is composed of a flexible member. Examples of the material of the flexible member include rubber and an elastomer. Also, the second pivoting portion 137 is composed of the non-flexible member. Note that the materials of the holding member 151, the second pivoting member 137, and the housing 211 may be the same as or different from each other.

In the present embodiment, the plug member 150 is constituted by coupling the holding member 151 and the plug member 152. Specifically, the holding member 151 has a through hole 151*a* (see FIG. 3) at the coupling location of the plug member 152. Part of the plug member 152 is fit into the through hole 151*a*. Accordingly, the holding member 151 and the plug member 152 are coupled.

Also, the plug main body 152 includes a plug member 161 for covering the liquid insertion portion 42. The plug portion 161 has a bottomed circular tube shape with an opening 168 for sealing the liquid insertion portion 42, and as shown in FIG. 13, the plug member 161 includes a body portion that extends toward the lower end from the upper end in the Z axis direction.

Also, the plug member 150 is provided with a support portion 170 that is coupled to the holding member 151. The support portion 170 supports the end portion 169 forming the opening 168 of the plug member 161. The support portion 170 is provided on the first pivoting portion 154 side of the end portion 169. The support portion 170 has an approximately planar support surface 170*a* and comes into contact with the end portion 169 of the plug portion 161 above the support surface 170*a*, thereby supporting the end portion 169 of the plug portion 161. Accordingly, when the plug member 150 is pivoted and the plug main body 152 is removed from the liquid insertion portion 42, the plug main body 152 can be made less likely to come off of the holding member 151.

Figure 15:
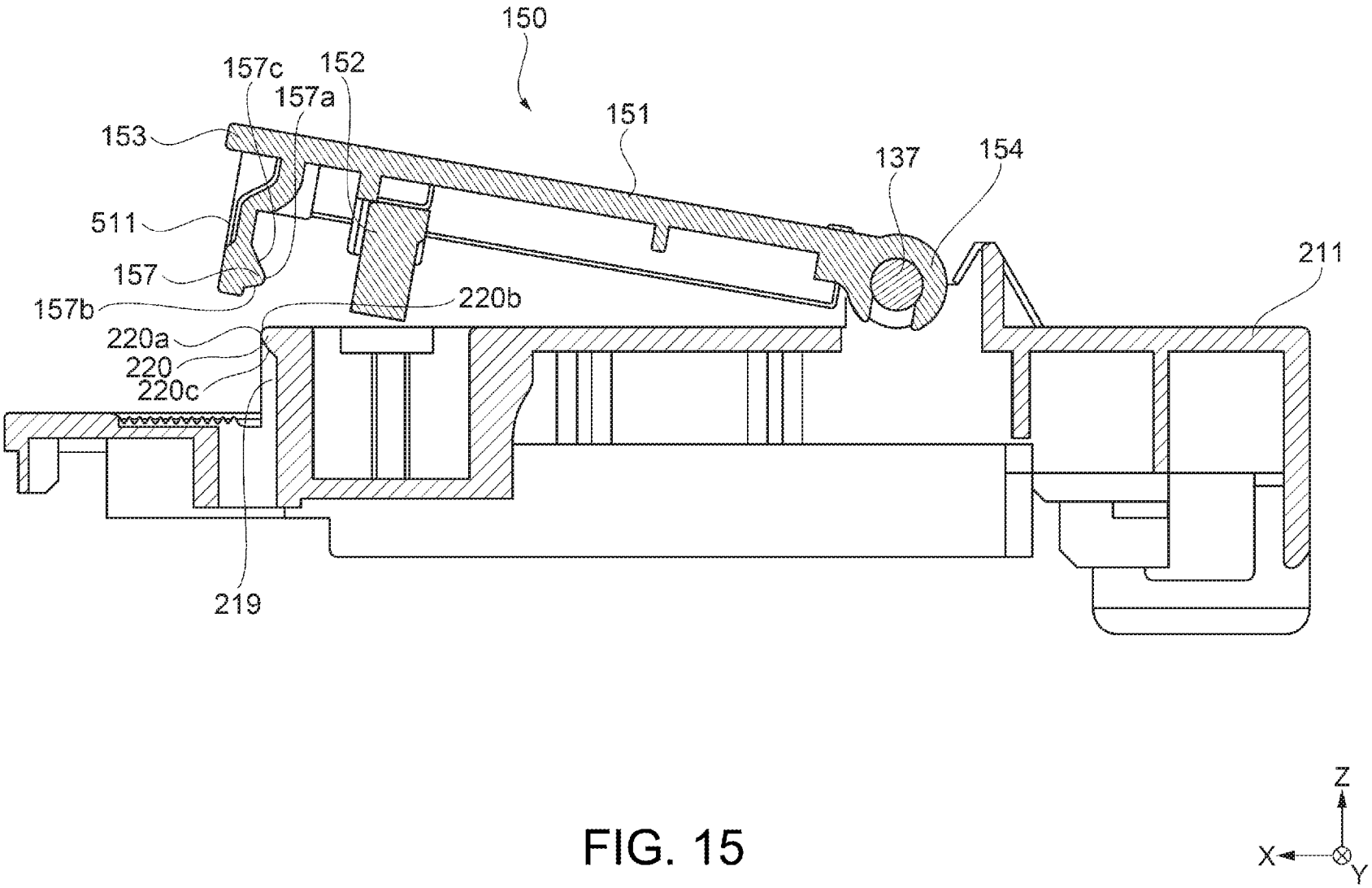
FIG. 15 is a cross-sectional view showing a partial configuration of the liquid supply unit according to the first embodiment.

Next, a configuration for a state in which the first housing 211 and the plug member 150 are locked will be described. FIG. 15 is a cross-sectional view showing a partial configuration of a liquid supply unit, and is a cross-sectional view taken along line B-B in FIG. 4.

As shown in FIG. 15, the plug member 150 is provided with a first protrusion 157 that is provided so as to be displaceable so that the plug member 150 locks onto the first housing 211.

Also, the first housing 211 is provided with a second protrusion 220 that comes into contact with the first protrusion 157 and displaces the first protrusion 157 when the plug member 150 pivots toward the liquid injection portion 42, the contact with the first protrusion 157 being canceled and the displacement of the first protrusion being returned to normal when the plug member 150 further pivots and is locked onto the first housing 211.

When the plug member 150 pivots and is locked onto the first housing 211, the first protrusion 157 and the second protrusion 220 are arranged at the position at which the liquid injection path 42 is sealed by the plug main body 152 of the plug member 150. Note that the position at which the liquid injection portion 42 is sealed by the plug main body 152 of the plug member 150 is the height position in the state in which the liquid supply unit 200 is used.

Specifically, a plate portion 158 that extends in the −Z axis direction from the holding member 151 is provided on the one end 511 side of the holding member 151 of the plug member 150. Also, the first protrusion 157, which has a shape that protrudes from the surface of the plate portion 158 to the plug main body 152, is formed at the end portion in the −Z direction of the plate portion 158. Also, the second protrusion 220, which has a shape that protrudes in the +X direction is formed on the edge portion 219 formed near the through hole 260 (see FIG. 9) on the upper face 211*a* side of the first housing 211.

The thickness in the X axis direction of the plate portion 158 is approximately about ⅓ of the thickness (the width in the Z direction of the side end 513) in the Z direction of the holding member 151, and the plate portion 158 is formed with a relatively small thickness. Accordingly, when the first protrusion 157 comes into contact with the second protrusion 220, the first protrusion 157 can be made more likely to deform in the X axis direction.

Also, the width in the Y axis direction of the first protrusion 157 is approximately ⅙ the width in the Y axis direction of the holding member 151. Note that the width in the Y axis direction of the second protrusion 220 is also approximately ⅙ the width in the Y axis direction of the holding member 151. Accordingly, the load on the user's fingers is reduced due to contact between the first protrusion 157 and the second protrusion 220, and the operations of locking and unlocking the first housing 211 and the plug member 150 can be performed easily.

Note that in the present embodiment, the first protrusion 157 and the second protrusion 220 are arranged on the +Y axis direction side of the holding member 151, but there is no limitation to this, and for example, the first protrusion 157 and the second protrusion 220 may be arranged on the −Y axis direction side of the holding member 151 or at a central portion in the Y axis direction of the holding member 151.

The locking between the first housing 211 and the plug member 150 of the present embodiment indicates being engaged and stopped, and therefore the state in which the members are mutually engaged may or may not be maintained after they are stopped due to temporary locking. That is, when the first housing 211 and the plug member 150 are locked, the first housing 211 and the plug member 150 may be configured to relatively move slightly.

Next, a method of locking the first housing and the plug member will be described.

Figure 16:
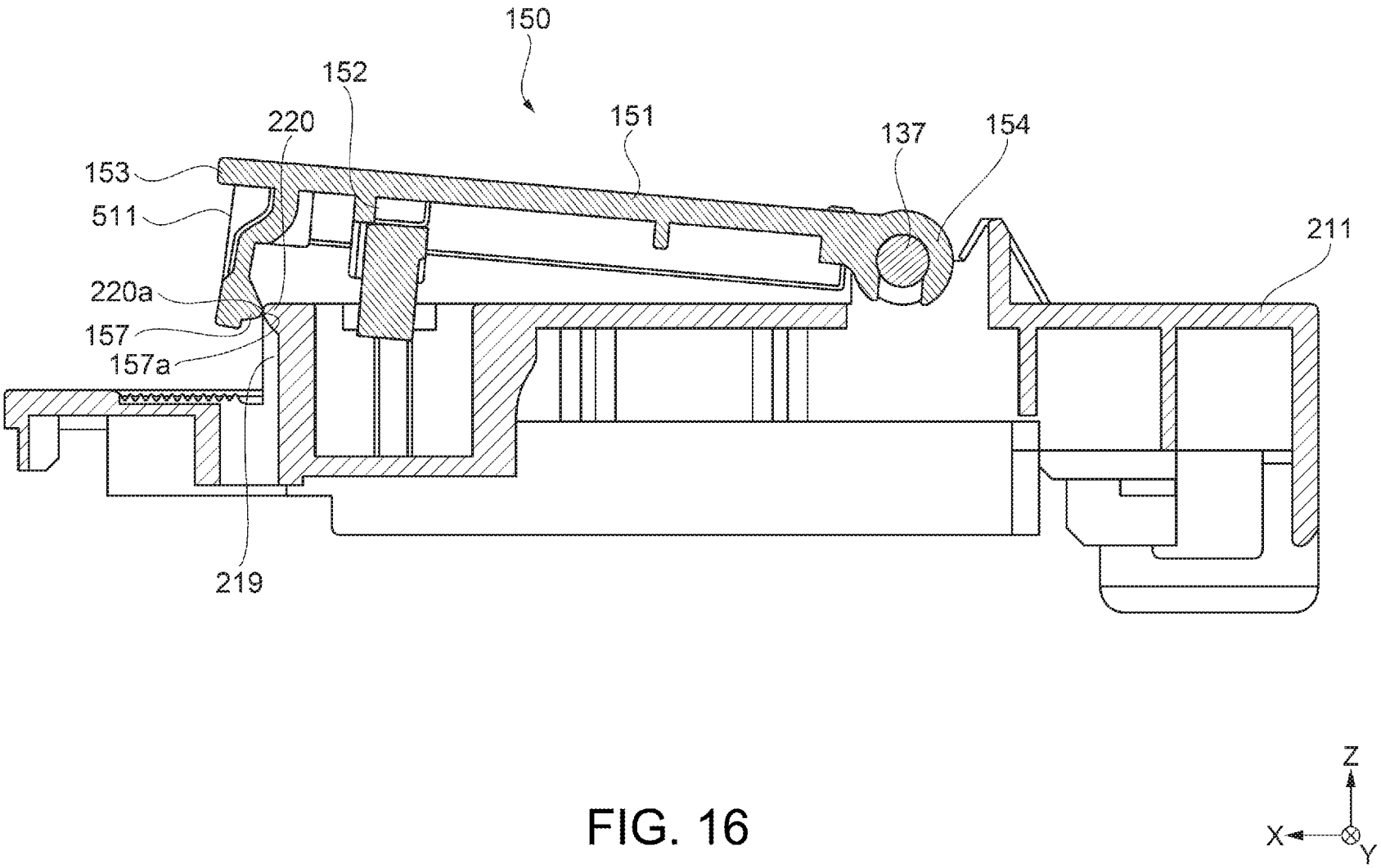
FIG. 16 is a cross-sectional view for illustrating a state in which the first housing and the plug member are locked, according to the first embodiment.
Figure 17:
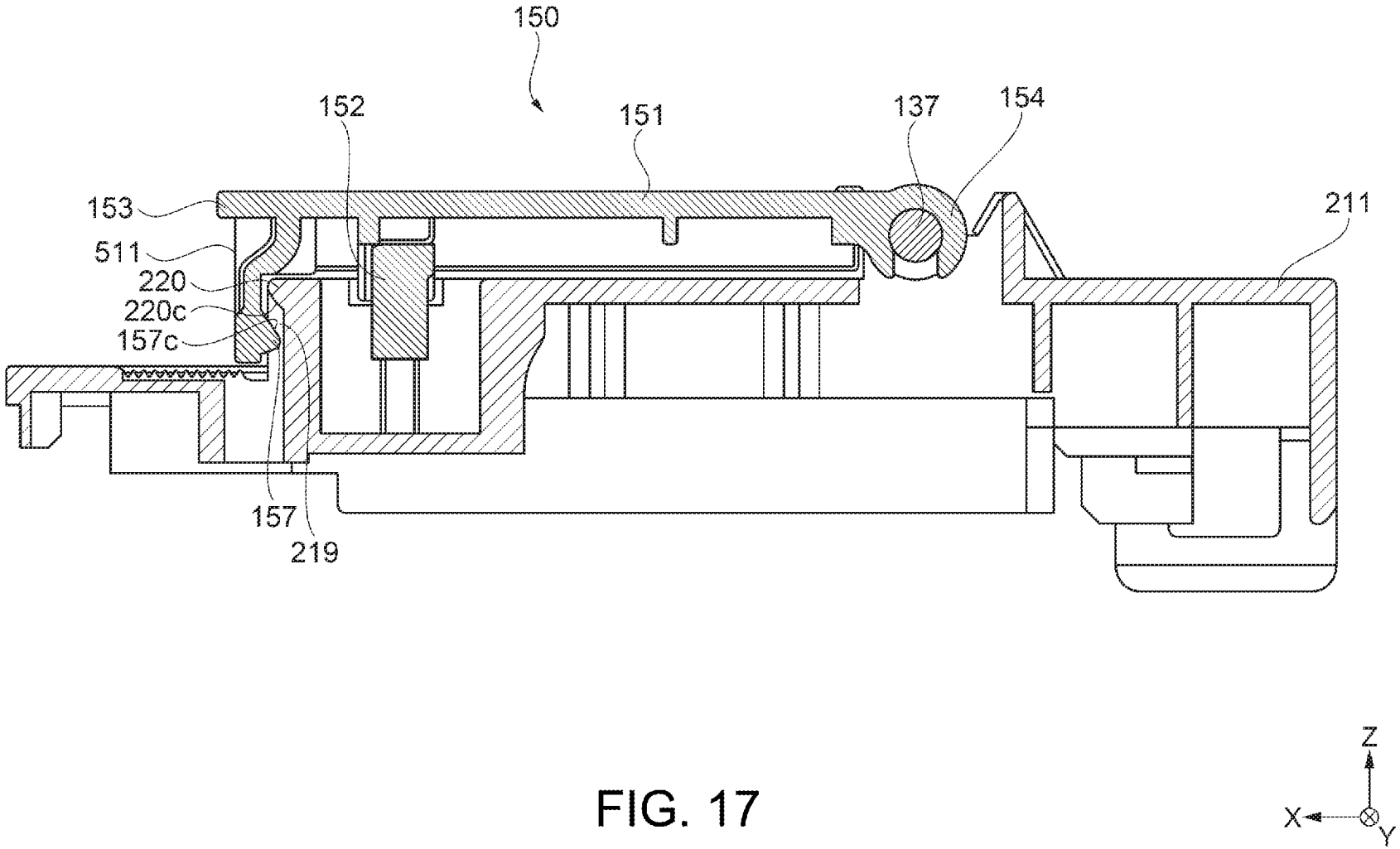
FIG. 17 is a cross-sectional view for illustrating a state in which the first housing and the plug member are locked, according to the first embodiment.

FIGS. 16 and 17 are cross-sectional views for illustrating a state in which the first housing and the plug member are locked, and is a cross-sectional view taken along line B-B in FIG. 4.

Note that in the present embodiment, as shown in FIG. 14, a method for causing a transition from a state in which the plug member 150 is pivoted and is locked by the third protrusion 180, to a state in which the first housing 211 and the plug member 150 are locked, will be described.

First, the user pivots the plug member 150 toward the liquid injection portion 42 while gripping the gripping portion 153 with fingers. Upon doing so, the first protrusion 157 and the second protrusion 220 come into contact. Specifically, a surface 157*b* in front of a peak portion 157*a* of the first protrusion 157 and a surface 220*b* in front of a peak portion 220*a* of the second protrusion 220 come into contact.

Next, the user further pivots the plug member 150 toward the liquid injection portion 42 while gripping the gripping portion 153 with fingers. Upon doing so, as shown in FIG. 16, the peak portion 157*a* of the first protrusion 157 and the peak portion 220*a* of the second protrusion 220 come into contact. Note that from the time when the face 157*b* in front of the peak portion 157*a* of the first protrusion 157 and the face 220*b* in front of the peak portion 220*a* of the second protrusion 220 come into contact to the time when the peak portion 157*a* of the first protrusion 157 and the peak portion 220*b* of the second protrusion 220 come into contact, the first protrusion 157 receives a repulsive force from the second protrusion 220 due to the contact pressure between the first protrusion 157 and the second protrusion 220. Accordingly, the first protrusion 157 moves in the +X axis direction. That is, the −Z axis end portion of the plate portion 158 deforms in the +X axis component direction. Then, at this time, the maximum load is applied to the user's fingers.

Next, the user further pivots the plug member 150 toward the liquid injection portion 42 while gripping the gripping portion 153 with fingers. Upon doing so, the contact between the peak portion 157*a* of the first protrusion 157 and the peak portion 220*a* of the second protrusion 220 is canceled, and as shown in FIG. 17, the first housing 211 and the plug member 150 are locked. Then, the liquid injection portion 42 is sealed by the plug main body 152.

Here, when the contact between the peak portion 157*a* of the first protrusion 157 and the peak portion 220*a* of the second protrusion 220 is canceled, the displacement of the first protrusion 157 returns to normal. Also, at this time, the load applied to the user's fingers is reduced all at once. That is, the user is released from the contact pressure between the first protrusion 157 and the second protrusion 220 and receives a click sensation. Also, when the contact between the first protrusion 157 and the second protrusion 220 is released, for example, a "click" sound is generated, and the user can hear that sound.

Note that if a transition is made from the state in which the first housing 211 and the plug member 150 are locked to the state in which the plug member 150 is pivoted and is locked by the third protrusion 180, an operation that is the inverse of that described above is performed.

Specifically, in the state shown in FIG. 17, the plug member 150 is pivoted away from the liquid injection portion 42 while the user grips the gripping portion 153 with fingers. Upon doing so, a face 157*c* in front of the peak portion 157*a* of the first protrusion 157 and a face 220*c* in front of the peak portion 220*a* of the second protrusion 220 come into contact.

Next, the user further pivots the plug member 150 away from the liquid injection portion 42 while gripping the gripping portion 153 with fingers. Upon doing so, as shown in FIG. 16, the peak portion 157*a* of the first protrusion 157 and the peak portion 220*a* of the second protrusion 220 come into contact. Note that from the time when the face 157*c* in front of the peak portion 157*a* of the first protrusion 157 and the face 220*c* in front of the peak portion 220*a* of the second protrusion 220 come into contact to the time when the peak portion 157*a* of the first protrusion 157 and the peak portion 220*a* of the second protrusion 220 come into contact, the first protrusion 157 receives the repulsive force from the second protrusion 220 due to the contact pressure between the first protrusion 157 and the second protrusion 220. Accordingly, the first protrusion 157 is displaced in the +X axis direction. Then, at this time, the maximum load is applied to the user's fingers.

Next, the user further pivots the plug member 150 away from the liquid injection portion 42 while gripping the gripping portion 153 with fingers. Upon doing so, the contact between the peak portion 157*a* of the first protrusion 157 and the peak portion 220*a* of the second protrusion 220 is canceled, and as shown in FIG. 15, the state in which the first housing 211 and the plug member 150 are locked is canceled. Here, when the contact between the peak portion 157*a* of the first protrusion 157 and the peak portion 220*a* of the second protrusion 220 is canceled, the displacement of the first protrusion 157 returns to normal. Also, at this time, the load applied to the user's fingers is reduced all at once. That is, the user is released from the contact pressure between the first protrusion 157 and the second protrusion 220 and receives a click sensation. Also, when the contact between the first protrusion 157 and the second protrusion 220 is released, for example, a "click" sound is generated, and the user can hear that sound.

As described above, according to the present embodiment, the following effects can be obtained.

When the plug member 150 is to be locked onto the first housing 211, in the process of pivoting the plug member 150, the first protrusion 157 and the second protrusion 220 are brought into contact and the first protrusion is displaced. Thereafter, by further pivoting the plug member 150, the contact between the first protrusion 157 and the second protrusion 220 is canceled and the displacement of the first protrusion 157 returns to normal. In this series of operations, the user receives the contact pressure when the first protrusion 157 and the second portion 220 are in contact, and thereafter the user is released from the contact pressure. That is, in the series of operations for locking the plug member 150 onto the first housing 211, the user receives a click sensation. Accordingly, the user can reliably lock the plug member 150 onto the first housing 211 without confirming using eyesight.

Also, when the state in which the plug member 150 and the first housing 211 are locked is to be canceled, the user similarly receives the contact pressure when the first protrusion 157 and the second protrusion 220 are in contact, and thereafter the user is released from the contact pressure and thus feels a click sensation. Accordingly, the state in which the plug member 150 and the first housing 211 are locked can be reliably canceled.

Also, when the liquid injection portion 42 is to be sealed by the plug member 150, in the process of pivoting the plug member 150, the user receives a click sensation. Accordingly, the user can reliably seal the liquid injection portion 42 using the plug member 150 without confirming the sealed state of the liquid injection portion 42 using eyesight. Accordingly, it is possible to prevent the ink contained in the liquid tank 30 from flowing out of the liquid injection portion 42, and to reduce the occurrence of inconveniences such as evaporation of the ink contained in the liquid tank 30.

In particular, since the liquid ejection apparatus 1 according to the present embodiment is of a so-called on-carriage type, if the sealing state of the liquid injection portion 42 is insufficient, there is a possibility that the ink in the liquid tank 30 will flow out from the liquid injection portion 42 due to vibration caused by the reciprocal movement of the carriage 19 and an inconvenience such as the ink sticking to the drive portions or the like inside of the outer shell 100 will occur. However, according to the present embodiment, since the user can confirm that the liquid injection portion 42 has been sealed by the plug member 150, the above-described problem can be solved.

Second Embodiment

Next, a second embodiment will be described. Note that the basic configuration of the liquid ejection apparatus is similar to that of the first embodiment, and therefore description thereof will be omitted. A configuration different from that of the first embodiment, that is, a configuration relating to the state in which the first housing and the plug member of the liquid supply unit are locked, will be described. Note that configurations that are similar to those of the first embodiment are denoted by identical reference numerals.

Figure 18:
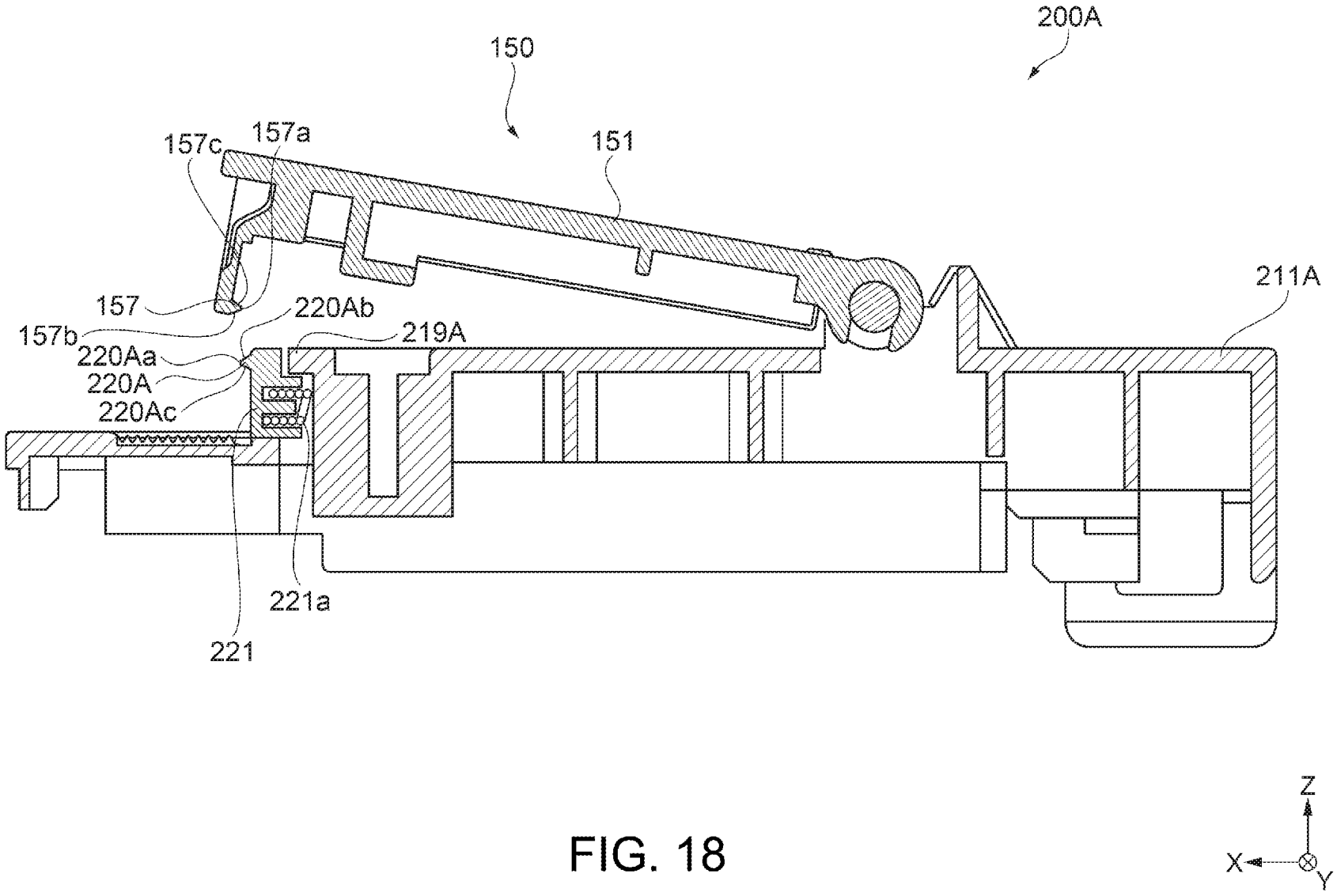
FIG. 18 is a cross-sectional view showing a partial configuration of a liquid supply unit according to a second embodiment.

FIG. 18 is a cross-sectional view showing a partial configuration of a liquid supply unit, and is a cross-sectional view taken along line B-B in FIG. 4. As shown in FIG. 18, the plug member 150 of the liquid supply unit 200A is provided with the first protrusion 157 that is configured to lock the plug member 150 onto the first housing 211A. Note that the configuration of the first protrusion 157 is similar to that of the first embodiment, and therefore description thereof will be omitted.

Also, the first housing 211A is provided with a second protrusion 220A that comes into contact with the first protrusion 157 and is displaced when the plug member 150 pivots toward the liquid injection portion 42, and the contact between the first protrusion 157 and the second protrusion 220A being canceled and the displacement returning to normal when the plug member 150 further pivots and is locked onto the first housing 211. That is, in the present embodiment, in the operation of locking the first housing 211A and the plug member 150, the second protrusion 220A is configured to be displaceable.

When the plug member 150 pivots and is locked onto the first housing 211A, the first protrusion 157 and the second protrusion 220 are arranged at the position at which the liquid injection portion 42 is sealed by the plug main body 152 of the plug member 150. Note that the position at which the liquid injection portion 42 is sealed by the plug main body 152 of the plug member 150 is the height position in the state in which the liquid supply unit 200A is used.

In the present embodiment, a block-shaped moving body 221 that can be displaced in the X axis direction is provided on an edge portion 219A formed near the through hole 260 (see FIG. 9) on the upper surface 211*a* side of the first housing 211. Also, a compressed coil spring 221*a* that biases the moving member 221 in the +X axis direction is arranged inside of the moving member 221. Also, the second protrusion 220A is formed on the end portion in the +X axis direction of the moving member 221.

Note that the liquid supply unit 200A of the present embodiment has a third protrusion 180 and a fourth protrusion 156, but since they are similar to those of the first embodiment, description thereof is omitted. Also, the liquid supply unit 200A is configured to be able to reliably lock onto the liquid tank 30 and the second housing 212, that is, to be able to reliably engage with the liquid supply port 505 and the liquid introduction needle portion 122, but this configuration is also similar to that of the first embodiment, and therefore description thereof is omitted (see the configurations of the pressing portion 270 and the pressed portion 70 of FIGS. 8 and 9).

Next, a method of locking the first housing and the plug member will be described.

Figure 19:
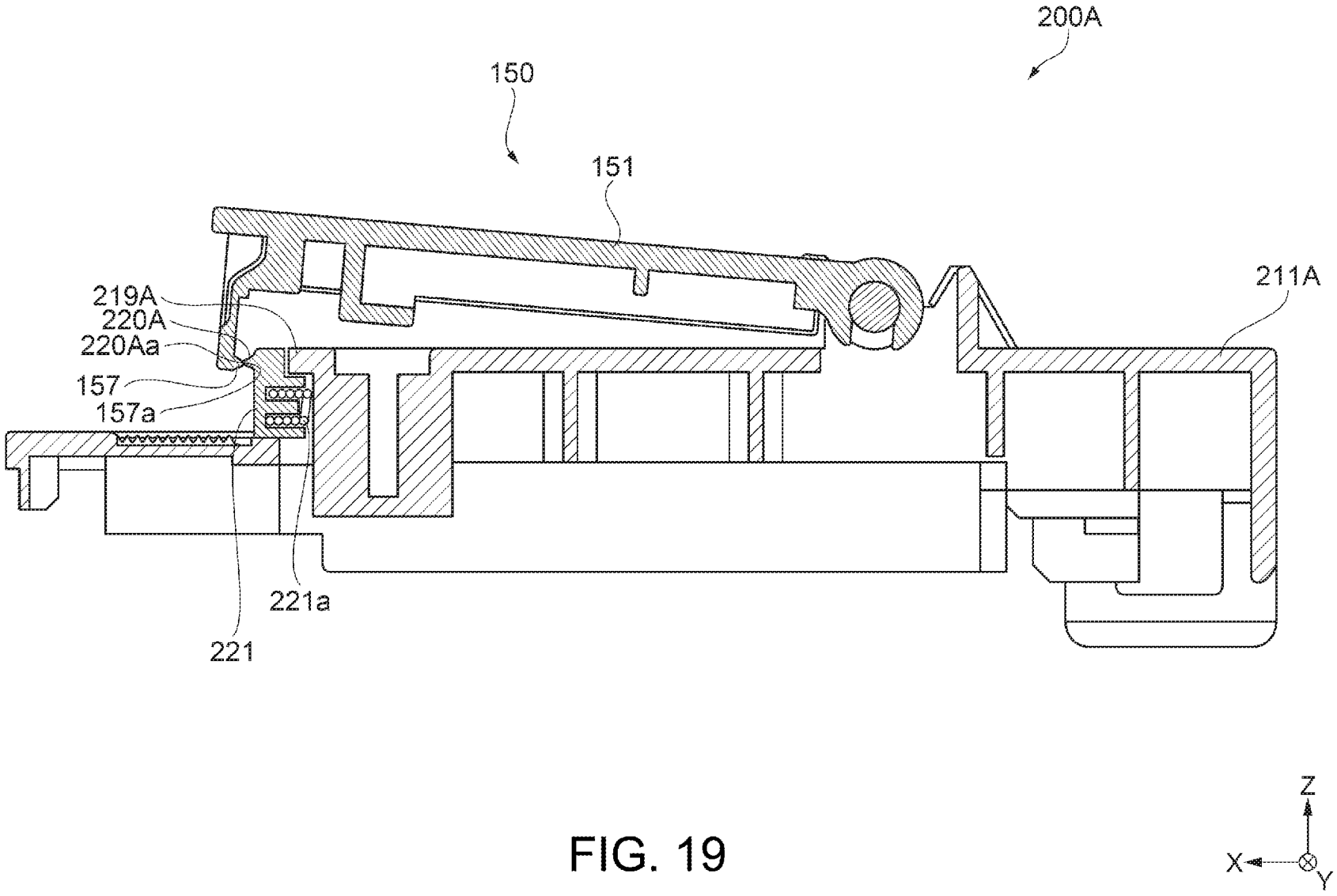
FIG. 19 is a cross-sectional view for illustrating a state in which the first housing and the plug member are locked, according to the second embodiment.
Figure 20:
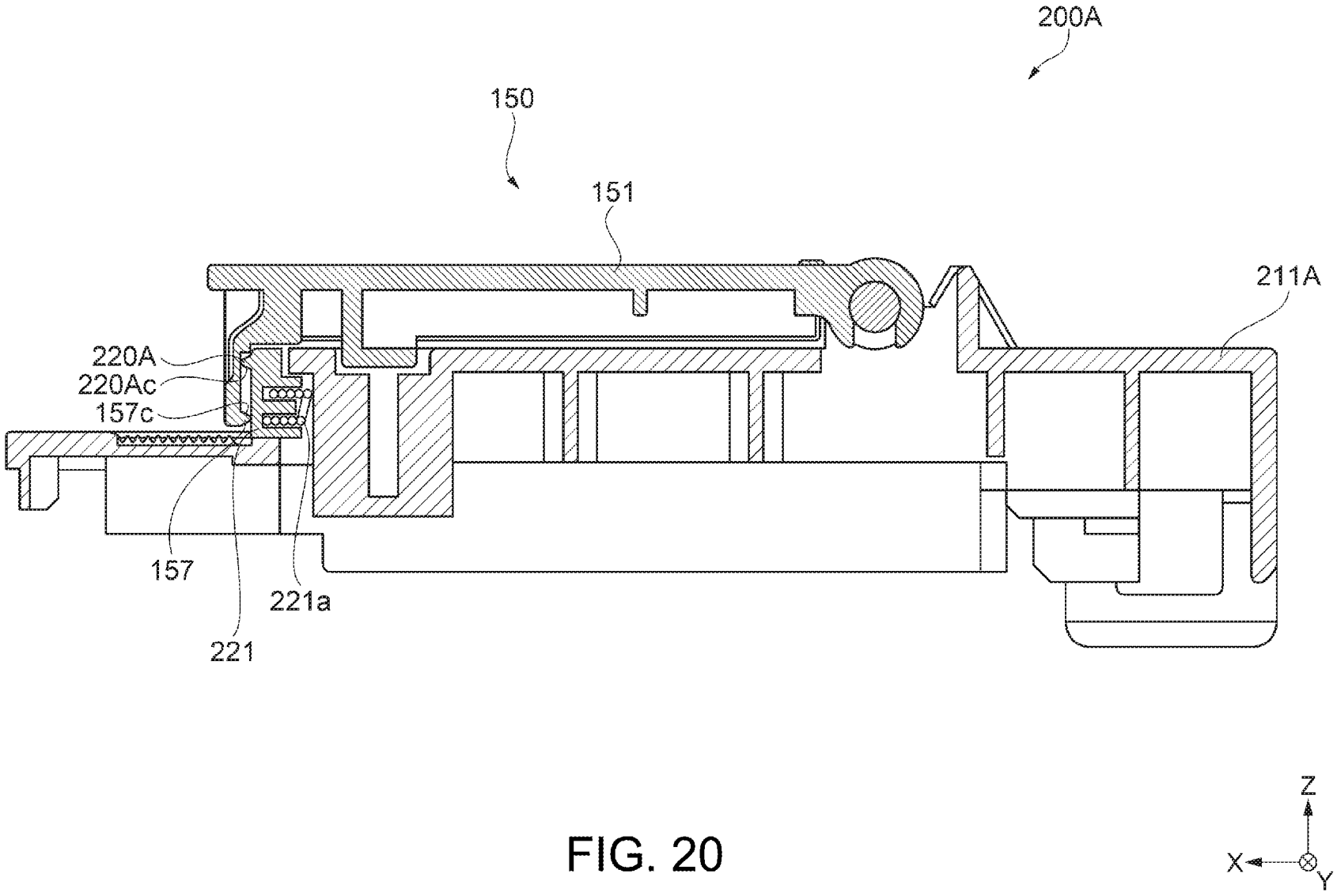
FIG. 20 is a cross-sectional view for illustrating a state in which the first housing and the plug member are locked, according to the second embodiment.

FIGS. 19 and 20 are cross-sectional views for illustrating a state in which the first housing and the plug member are locked, and are cross-sectional views taken along line B-B in FIG. 4.

Note that the present embodiment describes a method for causing a transition from a state in which the plug member 150 is pivoted and locked by the third protrusion 180 to a state in which the first housing 211A and the plug member 150 are engaged.

First, the user pivots the plug member 150 toward the liquid injection portion 42 while gripping the gripping portion 153 with fingers. Upon doing so, the first protrusion 157 and the second protrusion 220A come into contact. Specifically, the face 157*b* in front of the peak portion 157*a* of the first protrusion 157 and a face 220Ab in front of a peak portion 220Aa of the second protrusion 220A come into contact.

Next, the user further pivots the plug member 150 toward the liquid injection portion 42 while gripping the gripping portion 153 with fingers. Upon doing so, as shown in FIG. 19, the peak portion 157*a* of the first protrusion 157 and the peak portion 220Aa of the second protrusion 220A come into contact. Note that from the time when the face 157*b* in front of the peak portion 157*a* of the first protrusion 157 and the face 220Ab in front of the peak portion 220Aa of the second protrusion 220A come into contact to the time when the peak portion 157*a* of the first protrusion 157 and the peak portion 220Aa of the second protrusion 220A come into contact, the second protrusion 220A is pressed from the first protrusion 157 side by the contact pressure between the first protrusion 157 and the second protrusion 220A. Upon doing so, the compressed coil spring 221*a* is compressed in the −X direction. Accordingly, the moving member 221 moves in the −X axis direction, and accompanying this, the second protrusion 220A is displaced in the −X axis direction. Then, at this time, the maximum load is applied to the user's fingers.

Next, the user further pivots the plug member 150 toward the liquid injection portion 42 while gripping the gripping portion 153 with fingers. Upon doing so, the contact between the peak portion 157*a* of the first protrusion 157 and the peak portion 220Aa of the second protrusion 220A is canceled, and as shown in FIG. 20, the first housing 211A and the plug member 150 are locked. Then, the liquid injection portion 42 is sealed by the plug main body 152.

Here, when the contact between the peak portion 157*a* of the first protrusion 157 and the peak portion 220Aa of the second protrusion 220A is canceled, the displacement of the second protrusion 220A returns to normal. Also, at this time, the load applied to the user's fingers is reduced all at once. That is, the user is released from the contact pressure between the first protrusion 157 and the second protrusion 220A and receives a click sensation. Also, when the contact between the first protrusion 157 and the second protrusion 220A is released, for example, a "click" sound is generated, and the user can hear that sound.

Note that if a transition is made from the state in which the first housing 211A and the plug member 150 are locked to the state in which the plug member 150 is pivoted and is locked by the third protrusion 180, an operation that is the inverse of that described above is performed.

Specifically, in the state shown in FIG. 20, the plug member 150 is pivoted away from the liquid injection portion 42 while the user grips the gripping portion 153 with fingers. Upon doing so, the face 157*c* in front of the peak portion 157*a* of the first protrusion 157 and the face 220Ac in front of the peak portion 220Aa of the second protrusion 220A come into contact.

Next, the user further pivots the plug member 150 away from the liquid injection portion 42 while gripping the gripping portion 153 with fingers. Upon doing so, as shown in FIG. 19, the peak portion 157*a* of the first protrusion 157 and the peak portion 220Aa of the second protrusion 220A come into contact. Note that from the time when the face 157*c* in front of the peak portion 157*a* of the first protrusion 157 and the face 220Ac in front of the peak portion 220Aa of the second protrusion 220A come into contact to the time when the peak portion 157*a* of the first protrusion 157 and the peak portion 220Aa of the second protrusion 220A come into contact, the second protrusion 220A is pressed from the first protrusion 157 side due to the contact force between the first protrusion 157 and the second protrusion 220A. Upon doing so, the compressed coil spring 221*a* is compressed in the −X direction. Accordingly, the moving member 221 moves in the −X axis direction, and accompanying this, the second protrusion 220A is displaced in the −X axis direction. Then, at this time, the maximum load is applied to the user's fingers.

Next, the user further pivots the plug member 150 away from the liquid injection portion 42 while gripping the gripping portion 153 with fingers. Upon doing so, the contact between the peak portion 157*a* of the first protrusion 157 and the peak portion 220Aa of the second protrusion 220A is canceled, and as shown in FIG. 18, the state in which the first housing 211A and the plug member 150 are locked is canceled. Here, when the contact between the peak portion 157*a* of the first protrusion 157 and the peak portion 220Aa of the second protrusion 220A is canceled, the displacement of the second protrusion 220A returns to normal. Also, at this time, the load applied to the user's fingers is reduced all at once. That is, the user is released from the contact pressure between the first protrusion 157 and the second protrusion 220A and receives a click sensation. Also, when the contact between the first protrusion 157 and the second protrusion 220A is released, for example, a "click" sound is generated, and the user can hear that sound.

As described above, according to the present embodiment, the following effects can be obtained.

When the plug member 150 is to be locked onto the first housing 211A, in the process of pivoting the plug member 150, the first protrusion 157 and the second protrusion 220A are brought into contact and the second protrusion 220A is displaced. Thereafter, by further pivoting the plug member 150, the contact between the first protrusion 157 and the second protrusion 220A is canceled and the displacement of the second protrusion 220A returns to normal. In this series of operations, the user receives the contact pressure when the first protrusion 157 and the second portion 220A are in contact, and thereafter the user is released from the contact pressure. That is, in the series of operations for locking the plug member 150 onto the first housing 211A, the user receives a click sensation. Accordingly, the user can reliably lock the plug member 150 onto the first housing 211A without confirming by eyesight.

Also, when the state in which the plug member 150 and the first housing 211A are locked is to be canceled, the user similarly receives the contact pressure when the first protrusion 157 and the second protrusion 220A are in contact, and thereafter the user is released from the contact pressure and thus feels a click sensation. Accordingly, the state in which the plug member 150 and the first housing 211A are locked can be reliably canceled.

Also, when the liquid injection portion 42 is to be sealed by the plug member 150, in the process of pivoting the plug member 150, the user receives a click sensation. Accordingly, the user can reliably seal the liquid injection portion 42 using the plug member 150 without checking the locked state of the liquid injection portion 42 using eyesight. Accordingly, it is possible to prevent the ink contained in the liquid tank 30 from flowing out of the liquid injection portion 42, and to reduce the occurrence of inconveniences such as evaporation of the ink contained in the liquid tank 30.

In particular, since the liquid ejection apparatus 1 according to the present embodiment is of a so-called on-carriage type, if the sealing state of the liquid injection portion 42 is insufficient, there is a possibility that the ink in the liquid tank 30 will flow out from the liquid injection portion 42 due to vibration caused by the reciprocal movement of the carriage 19 and fatal damage such as the ink sticking to the drive portions or the like inside of the outer shell 100 will be received. However, according to the present embodiment, since the user can confirm that the liquid injection portion 42 has been sealed by the plug member 150, the above-described problem can be solved.

Note that the present disclosure is not limited to the above-described embodiments, and various modifications, improvements, and the like can be added to the above-described embodiments. Variations will be stated hereinafter.

Variation 1

In the liquid supply unit 200 of the first embodiment, a configuration is used in which the second protrusion 220 is received in the first housing 211 and the first protrusion 157 is displaced, but there is no limitation to this. For example, the liquid supply unit may be a liquid supply unit configured to supply a liquid to a liquid ejection head of a liquid ejection apparatus, the liquid supply unit including: a liquid containing body configured to contain a liquid; a liquid injection portion that is provided in the liquid containing body and through which the liquid can be injected into the liquid containing body; and a lever-shaped plug member capable of sealing the liquid injection portion. The plug member may include: a first pivoting portion that is configured to pivot the plug member; and a first protrusion provided to be displaceable in order to lock the plug member onto the liquid containing body. The liquid containing body may include: a second pivoting portion into which the first pivoting portion is fit; and a second protrusion configured to displace the first protrusion by coming into contact with the first protrusion when the plug member pivots toward the liquid injection portion, the contact with the first protrusion being canceled and the displacement of the first protrusion being returned to normal when the plug member further pivots and is locked onto the liquid containing body. That is, it is also possible to use a configuration in which the second protrusion is provided in the liquid tank serving as the liquid containing body.

Also, when the plug member pivots and is locked onto the liquid containing body, the first protrusion and the second protrusion are arranged at the position at which the liquid injection portion is sealed by the plug member. Note that the position at which the liquid port is sealed by the plug member is the height position of the liquid supply unit during use. Also, similarly to the first embodiment, the third protrusion 180 and the fourth protrusion 156 may be provided. In this manner as well, the above-described effects can be obtained.

Variation 2

In the liquid supply unit 200A of the second embodiment, a configuration is used in which the first housing 211 is provided with the second protrusion 220A and the second protrusion 220A is displaced with respect to the first protrusion 157, but there is no limitation to this. For example, the liquid supply unit may be a liquid supply unit configured to supply a liquid to a liquid ejection head of a liquid ejection apparatus, the liquid supply unit including: a liquid containing body configured to contain a liquid; a liquid injection portion that is provided in the liquid containing body and through which the liquid can be injected into the liquid containing body; and a lever-shaped plug member configured to seal the liquid injection portion. The plug member may include: a first pivoting portion that is configured to pivot the plug member; and a first protrusion provided to be displaceable in order to lock the plug member onto the liquid containing body. The liquid containing body may include: a second pivoting portion into which the first pivoting portion is fit; and a second protrusion that is provided so as to be displaceable, and is configured to come into contact with the first protrusion and be displaced when the plug member pivots toward the liquid injection portion, the contact with the first protrusion being canceled and the displacement of the first protrusion returning to normal when the plug member further pivots and is locked onto the liquid containing body. That is, it is also possible to use a configuration in which the displaceable second protrusion is provided in the liquid tank serving as the liquid containing body.

Also, when the plug member pivots and is locked onto the liquid containing body, the first protrusion and the second protrusion are arranged at the position at which the liquid injection portion is sealed by the plug member. Note that the position at which the liquid port is sealed by the plug member is the height position of the liquid supply unit during use. Also, similarly to the first embodiment, the third protrusion 180 and the fourth protrusion 156 may be provided. In this manner as well, the above-described effects can be obtained.

Variation 3

The liquid ejection apparatus 1 of the above-described embodiments was described as an on-carriage type of apparatus in which the liquid tank 30 is mounted on the carriage 19, but there is no limitation to this, and the liquid ejection apparatus 1 may also be an off-carriage type of apparatus. In this manner as well, the liquid injection portion 42 can be reliably sealed by the plug member through the engagement mechanism of the plug member and the first housing, and therefore, for example, when the liquid ejection apparatus is moved by being carried, leakage of the ink from the liquid injection portion 42 can be prevented, even if the liquid tank 30 vibrates.

Variation 4

In the above embodiment, a configuration in the case of one liquid tank 30 has been described, but there is no limitation thereto. For example, a liquid ejection apparatus in which a plurality of liquid tanks are mounted may be used.

Variation 5

The present disclosure is not limited to an inkjet printer and a liquid tank configured to supply ink to an inkjet printer, and can also be applied to any liquid ejection apparatus that ejects liquid other than ink and a liquid tank for containing the liquid. For example, the present disclosure can be applied to the following various liquid ejection apparatuses and liquid tanks thereof.

(1) Image recording apparatuses such as a facsimile apparatus, (2) Color material ejection apparatuses used to manufacture color filters for image display apparatuses such as a liquid crystal display, (3) Electrode material ejection apparatuses used to form electrodes for organic EL (Electro Luminescence) displays, surface light emission displays (field emission displays, FED), or the like, (4) Liquid ejection apparatuses that eject liquid containing biological organic matter used to manufacture biochips, (5) Sample ejection apparatuses serving as precision pipettes, (6) Lubricating oil ejection apparatuses, (7) Resin liquid ejection apparatuses, (8) Liquid ejection apparatuses that perform pinpoint ejection of lubricating oil to precision machines such as a watch and a camera, (9) Liquid ejection apparatuses that eject transparent resin liquid such as UV-cured resin liquid onto substrates in order to form micro-hemispherical lenses (optical lenses) or the like used in optical communication elements or the like,

(10) Liquid ejection apparatuses that eject acid or alkaline etchant in order to etch substrates or the like, and

(11) Liquid ejection apparatuses that include liquid ejection heads for discharging a very small amount of any other kinds of droplet.

Note that "droplet" refers to a state of a liquid discharged from a liquid ejection apparatus, and includes droplets having a granular shape, a tear-drop shape, and a shape with a thread-like trailing end. In addition, the "liquid" mentioned here need only be a material, which can be ejected by a liquid ejection apparatus. For example, the "liquid" need only be a material in a state where a substance is in a liquid phase, and a liquid material having a high or low viscosity, sol, gel water, and other liquid materials such as an inorganic solvent, organic solvent, solution, liquid resin, and liquid metal (metallic melt) are also included as a "liquid". Furthermore, the "liquid" is not limited to being a single-state substance, and also includes particles of a functional material made from solid matter, such as pigment or metal particles, that are dissolved, dispersed, or mixed in a solvent, or the like. In addition, representative examples of the liquid include ink such as that described in the above embodiment, liquid crystal, or the like. Here, the "ink" encompasses general water-based ink and oil-based ink, as well as various types of liquid compositions such as gel ink and hot melt ink.

Hereinafter, content extracted from the embodiments will be described.

The liquid supply unit is a liquid supply unit configured to supply a liquid to a liquid ejection head of a liquid ejection apparatus, the liquid supply unit including: a liquid containing body configured to contain the liquid; a liquid injection portion that is provided in the liquid containing body and through which the liquid can be injected into the liquid containing body; a housing that covers the liquid containing body; and a lever-shaped plug member configured to seal the liquid injection portion. The plug member includes: a first pivoting portion that is configured to pivot the plug member; and a first protrusion provided so as to be displaceable in order to lock the plug member onto the housing. The housing includes: a second pivoting portion into which the first pivoting portion is to be fit; and a second protrusion configured to come into contact with the first protrusion and displace the first protrusion when the plug member pivots toward the liquid injection portion, the contact with the first protrusion being canceled and the displacement of the first protrusion being returned to normal when the plug member further pivots and is locked onto the housing.

According to this configuration, when the plug member is locked onto the housing, in the process of pivoting the plug member, the first protrusion of the plug member and the second protrusion of the housing come into contact and the first protrusion is displaced. Thereafter, by further pivoting the plug member, the contact between the first protrusion and the second protrusion is canceled and the displacement of the first protrusion returns to normal. In this series of operations, the user receives the contact pressure when the first protrusion and the second protrusion are in contact, and thereafter the user is released from the contact pressure. That is, in the series of operations for locking the plug member onto the housing, the user receives a click sensation. Accordingly, the user can reliably lock the plug member onto the housing without confirming by eyesight.

Also, when the state in which the plug member and the housing are locked is to be canceled, the user similarly receives the contact pressure when the first protrusion and the second protrusion are in contact, and thereafter the user is released from the contact pressure and thus feels a click sensation. Accordingly, the state in which the plug member and the housing are locked can be reliably canceled.

Note that the click sensation encompasses, for example, a "click" sound, a vibration, or the like that is generated when the first protrusion and the second protrusion come into contact and are unlocked, in addition to a response that can be felt by the user due to the above-described contact pressure and the like.

In the above-described liquid supply unit, the first protrusion and the second protrusion may be arranged at a position at which the liquid injection portion is sealed by the plug member when the plug member pivots and is locked onto the housing.

According to this configuration, when the liquid injection portion is sealed by the plug member, in the process of pivoting the plug member, the user receives a click sensation. Accordingly, the user can reliably seal the liquid injection portion using the plug member without confirming by eyesight. Accordingly, it is possible to prevent the liquid contained in the liquid containing body from flowing out of the liquid injection portion, and it is possible to reduce the occurrence of an inconvenience such as evaporation of the liquid contained in the liquid containing body.

In the above-described liquid supply unit, the housing may include a third protrusion configured to, when the plug member pivots away from the liquid injection portion, restrict the pivoting of the plug member and perform locking by coming into contact with an end portion on the first pivoting portion side of the plug member.

According to this configuration, the pivoting of the plug member is restricted by the third protrusion. Accordingly, it is possible to reliably confirm that the plug member has been locked at the liquid injection position at which the liquid is injected from the liquid injection portion. Also, it can be made easier to hook a finger into the plug member when closing the plug member, and handling of the plug member can be made easier.

The end portion of the liquid supply unit may be provided with a fourth protrusion configured to come into contact with the third protrusion when locked by the third protrusion.

According to this configuration, the plug member locks onto the third protrusion via the fourth protrusion, and therefore scratches and the like caused by the contact between the third protrusion and a portion other than the fourth protrusion can be made less likely to occur.

In the above-described liquid supply unit, the liquid containing body may include: a first positioning portion configured to perform positioning on a mounting axis when mounted in the housing; and a pressed portion to be pressed from one direction on the mounting axis by the housing. The housing may include: a first housing that covers the liquid containing body from one direction on the mounting axis; a second housing opposing the first housing; a second positioning portion that is provided in the second housing and is configured to lock the first positioning portion; and a pressing portion that is provided in the first housing and is configured to press the pressed portion in the one direction on the mounting axis. In the liquid containing body, when the pressed portion is pressed by the pressing portion, the first positioning portion may be locked onto the second positioning portion in conjunction with the pressing.

According to this configuration, when the liquid containing body is installed in the second housing, even if the state in which the first positioning portion of the liquid containing body and the second positioning portion of the second housing are locked is insufficient, when the first housing is installed on the second housing, the first positioning portion of the liquid containing body is locked onto the second positioning portion of the second housing due to the pressed portion of the liquid containing body being pressed by the pressing portion of the first housing. Accordingly, the liquid containing body and the housing can be reliably locked.

The liquid supply unit is a liquid supply unit configured to supply a liquid to a liquid ejection head of a liquid ejection apparatus, the liquid supply unit including: a liquid containing body configured to contain the liquid; a liquid injection portion that is provided in the liquid containing body and through which the liquid can be injected into the liquid containing body; a housing that covers the liquid containing body; and a lever-shaped plug member configured to seal the liquid injection portion. The plug member includes: a first pivoting portion that is configured to pivot the plug member; and a first protrusion that is configured to lock the plug member onto the housing. The housing includes: a second pivoting portion into which the first pivoting portion is to be fit; and a second protrusion that is provided so as to be displaceable, and is configured to come into contact with the first protrusion and be displaced when the plug member pivots toward the liquid injection portion, the contact with the protrusion being canceled and the displacement returning to normal when the plug member further pivots and is locked onto the housing.

According to this configuration, when the plug member is locked onto the housing, in the process of pivoting the plug member, the first protrusion of the plug member and the second protrusion of the housing come into contact and the second protrusion is displaced. Thereafter, by further pivoting the plug member, the contact between the first protrusion and the second protrusion is canceled and the displacement of the second protrusion returns to normal. In this series of operations, the user receives the contact pressure when the first protrusion and the second protrusion are in contact, and thereafter the user is released from the contact pressure. That is, in the series of operations for locking the plug member onto the housing, the user receives a click sensation. Accordingly, the user can reliably lock the plug member onto the housing without confirming by eyesight.

Also, when the state in which the plug member and the housing are locked is to be canceled, the user similarly receives the contact pressure when the first protrusion and the second protrusion are in contact, and thereafter the user is released from the contact pressure and thus feels a click sensation. Accordingly, the state in which the plug member and the housing are locked can be reliably canceled.

In the above-described liquid supply unit, the first protrusion and the second protrusion may be arranged at a position at which the liquid injection portion is sealed by the plug member when the plug member pivots and is locked onto the housing.

According to this configuration, when the liquid injection portion is sealed by the plug member, in the process of pivoting the plug member, the user receives a click sensation. Accordingly, the user can reliably seal the liquid injection portion using the plug member without confirming by eyesight. Accordingly, it is possible to prevent the liquid contained in the liquid containing body from flowing out of the liquid injection portion, and it is possible to reduce the occurrence of an inconvenience such as evaporation of the liquid contained in the liquid containing body.

The housing of the liquid supply unit may include a third protrusion configured to, when the plug member pivots away from the liquid injection portion, restrict the pivoting of the plug member and perform locking by coming into contact with an end portion on the first pivoting portion side of the plug member.

According to this configuration, the pivoting of the plug member is restricted by the third protrusion. Accordingly, it is possible to reliably confirm that the plug member has been locked at the liquid injection position at which the liquid is injected from the liquid injection portion. Also, it can be made easier to place a finger on the plug member when closing the plug member, and handling of the plug member can be made easier.

In the above-described liquid supply unit, the end portion may be provided with a fourth protrusion configured to come into contact with the third protrusion when locked by the third protrusion.

According to this configuration, the plug member locks onto the third protrusion via the fourth protrusion, and therefore scratches and the like caused by the contact between the third protrusion and a portion other than the fourth protrusion can be made less likely to occur.

In the above-described liquid supply unit, the liquid containing body may include: a first positioning portion configured to perform positioning on a mounting axis when mounted in the housing; and a pressed portion to be pressed from one direction on the mounting axis by the housing. The housing may include: a first housing that covers the liquid containing body from one direction on the mounting axis; a second housing opposing the first housing; a second positioning portion that is provided in the second housing and is configured to lock the first positioning portion; and a pressing portion that is provided in the first housing and is configured to press the pressed portion in the one direction on the mounting axis. In the liquid containing body, when the pressed portion is pressed by the pressing portion, the first positioning portion may be locked onto the second positioning portion in conjunction with the pressing.

According to this configuration, when the liquid containing body is installed in the second housing, even if the state in which the first positioning portion of the liquid containing body and the second positioning portion of the second housing are locked is insufficient, when the first housing is installed on the second housing, the first positioning portion of the liquid containing body is locked onto the second positioning portion of the second housing due to the pressed portion of the liquid containing body being pressed by the pressing portion of the first housing. Accordingly, the liquid containing body and the housing can be reliably locked.

The liquid supply unit is a liquid supply unit configured to supply a liquid to a liquid ejection head of a liquid ejection apparatus, the liquid supply unit including: a liquid containing body configured to contain the liquid; a liquid injection portion that is provided in the liquid containing body and through which the liquid can be injected into the liquid containing body; and a lever-shaped plug member configured to seal the liquid injection portion. The plug member includes: a first pivoting portion that is configured to pivot the plug member; and a first protrusion provided so as to be displaceable in order to lock the plug member onto the liquid containing body. The liquid containing body includes: a second pivoting portion into which the first pivoting portion is to be fit; and a second protrusion configured to come into contact with the first protrusion and displace the first protrusion when the plug member pivots toward the liquid injection portion, the contact with the first protrusion being canceled and the displacement of the first protrusion being returned to normal when the plug member further pivots and is locked onto the liquid containing body.

According to this configuration, when the plug member is locked onto the liquid storage body, in the process of pivoting the plug member, the first protrusion of the plug member and the second protrusion of the liquid containing body come into contact and the first protrusion is displaced. Thereafter, by further pivoting the plug member, the contact between the first protrusion and the second protrusion is canceled and the displacement of the first protrusion returns to normal. In this series of operations, the user receives the contact pressure when the first protrusion and the second protrusion are in contact, and thereafter the user is released from the contact pressure. That is, in the series of operations for locking the plug member onto the liquid containing body, the user receives a click sensation. Accordingly, the user can reliably lock the plug member onto the liquid containing body without confirming by eyesight.

Also, when the state in which the plug member and the liquid containing body are locked is to be canceled, the user similarly receives the contact pressure when the first protrusion and the second protrusion are in contact, and thereafter the user is released from the contact pressure and thus feels a click sensation. Accordingly, the state in which the plug member and the liquid containing body are locked can be reliably canceled.

In the above-described liquid supply unit, the first protrusion and the second protrusion may be arranged at a position at which the liquid injection portion is sealed by the plug member when the plug member pivots and is locked onto the liquid containing body.

According to this configuration, when the liquid injection portion is sealed by the plug member, in the process of pivoting the plug member, the user receives a click sensation. Accordingly, the user can reliably seal the liquid injection portion using the plug member without confirming by eyesight. Accordingly, it is possible to prevent the liquid contained in the liquid containing body from flowing out of the liquid injection portion, and it is possible to reduce the occurrence of an inconvenience such as evaporation of the liquid contained in the liquid containing body.

The liquid containing body of the liquid supply unit may include a third protrusion configured to, when the plug member pivots away from the liquid injection portion, restrict the pivoting of the plug member and perform locking by coming into contact with an end portion on the first pivoting portion side of the plug member.

According to this configuration, the pivoting of the plug member is restricted by the third protrusion. Accordingly, it is possible to reliably confirm that the plug member has been locked at the liquid injection position at which the liquid is injected from the liquid injection portion. Also, it can be made easier to place a finger on the plug member when closing the plug member, and handling of the plug member can be made easier.

The end portion of the liquid supply unit may be provided with a fourth protrusion configured to come into contact with the third protrusion when locked by the third protrusion.

According to this configuration, the plug member locks onto the third protrusion via the fourth protrusion, and therefore scratches and the like caused by the contact between the third protrusion and a portion other than the fourth protrusion can be made less likely to occur.

The liquid supply unit is a liquid supply unit configured to supply a liquid to a liquid ejection head of a liquid ejection apparatus, the liquid supply unit including: a liquid containing body configured to contain the liquid; a liquid injection portion that is provided in the liquid containing body and through which the liquid can be injected into the liquid containing body; and a lever-shaped plug member configured to seal the liquid injection portion. The plug member includes: a first pivoting portion that is configured to pivot the plug member; and a first protrusion that is configured to lock the plug member onto the liquid containing body. The liquid containing body includes: a second pivoting portion into which the first pivoting portion is to be fit; and a second protrusion that is provided so as to be displaceable, and is configured to come into contact with the first protrusion and be displaced when the plug member pivots toward the liquid injection portion, the contact with the protrusion being canceled and the displacement returning to normal when the plug member further pivots and is locked onto the liquid containing body.

According to this configuration, when the plug member is locked onto the liquid storage body, in the process of pivoting the plug member, the first protrusion of the plug member and the second protrusion of the liquid containing body are brought into contact and the second protrusion is displaced. Thereafter, by further pivoting the plug member, the contact between the first protrusion and the second protrusion is canceled and the displacement of the second protrusion returns to normal. In this series of operations, the user receives the contact pressure when the first protrusion and the second protrusion are in contact, and thereafter the user is released from the contact pressure. That is, in the series of operations for locking the plug member onto the liquid containing body, the user receives a click sensation. Accordingly, the user can reliably lock the plug member onto the liquid containing body without confirming by eyesight.

Also, when the state in which the plug member and the liquid containing body are locked is to be canceled, the user similarly receives the contact pressure when the first protrusion and the second protrusion are in contact, and thereafter the user is released from the contact pressure and thus feels a click sensation. Accordingly, the state in which the plug member and the liquid containing body are locked can be reliably canceled.

In the above-described liquid supply unit, the first protrusion and the second protrusion may be arranged at a position at which the liquid injection portion is sealed by the plug member when the plug member pivots and is locked onto the liquid containing body.

According to this configuration, when the liquid injection portion is sealed by the plug member, in the process of pivoting the plug member, the user receives a click sensation. Accordingly, the user can reliably seal the liquid injection portion using the plug member without confirming by eyesight. Accordingly, it is possible to prevent the liquid contained in the liquid containing body from flowing out of the liquid injection portion, and it is possible to reduce the occurrence of an inconvenience such as evaporation of the liquid contained in the liquid containing body.

The liquid containing body of the liquid supply unit may include a third protrusion configured to, when the plug member pivots away from the liquid injection portion, restrict the pivoting of the plug member and perform locking by coming into contact with an end portion on the first pivoting portion side of the plug member.

According to this configuration, the pivoting of the plug member is restricted by the third protrusion. Accordingly, it is possible to reliably confirm that the plug member has been locked at the liquid injection position at which the liquid is injected from the liquid injection portion. Also, it can be made easier to place a finger on the plug member when closing the plug member, and handling of the plug member can be made easier.

The end portion of the liquid supply unit may be provided with a fourth protrusion configured to come into contact with the third protrusion when locked by the third protrusion.

According to this configuration, the plug member locks onto the third protrusion via the fourth protrusion, and therefore scratches and the like caused by the contact between the third protrusion and a portion other than the fourth protrusion can be made less likely to occur.

A liquid ejection apparatus includes: a liquid ejection head; and the above-described liquid supply unit.

According to this configuration, for example, it is possible to provide a liquid ejection apparatus including a liquid supply unit according to which it is possible to confirm that, in the state in which the plug member and the housing are locked, the state in which the plug member and the liquid injection portion are locked, the state in which the liquid containing body and the housing are locked, and the like, the members are correctly locked.

What is claimed is:

1. A liquid supply unit configured to supply a liquid to a liquid ejection head of a liquid ejection apparatus, the liquid supply unit comprising:

a liquid containing body configured to contain the liquid;

a liquid injection portion that is provided in the liquid containing body and through which the liquid can be injected into the liquid containing body;

a housing that covers the liquid containing body; and a lever-shaped plug member configured to seal the liquid injection portion, wherein the plug member includes:

a first pivoting portion that is configured to pivot the plug member; and a first protrusion provided so as to be displaceable in order to lock the plug member onto the housing, the first protrusion having a distal end that is oriented towards the first pivoting portion, and the housing includes:

a second pivoting portion into which the first pivoting portion is to be fit; and a second protrusion configured to come into contact with the first protrusion and displace the first protrusion when the plug member pivots toward the liquid injection portion, the contact with the first protrusion being canceled and the displacement of the first protrusion being returned to normal when the plug member further pivots and is locked onto the housing.

2. The liquid supply unit according to claim 1, wherein the first protrusion and the second protrusion are arranged at a position at which the liquid injection portion is sealed by the plug member when the plug member pivots and is locked onto the housing.

3. The liquid supply unit according to claim 1, wherein the housing includes a third protrusion configured to, when the plug member pivots away from the liquid injection portion, restrict the pivoting of the plug member and perform locking by coming into contact with an end portion on the first pivoting portion side of the plug member.

4. The liquid supply unit according to claim 3, wherein the end portion is provided with a fourth protrusion configured to come into contact with the third protrusion when locked by the third protrusion.

5. The liquid supply unit according to claim 1, wherein the liquid containing body includes:

a first positioning portion configured to perform positioning on a mounting axis when mounted in the housing; and a pressed portion to be pressed from one direction on the mounting axis by the housing, the housing includes:

a first housing that covers the liquid containing body from one direction on the mounting axis;

a second housing opposing the first housing;

a second positioning portion that is provided in the second housing and is configured to lock the first positioning portion; and a pressing portion that is provided in the first housing and is configured to press the pressed portion in the one direction on the mounting axis, and in the liquid containing body, when the pressed portion is pressed by the pressing portion, the first positioning portion is locked onto the second positioning portion in conjunction with the pressing.

6. A liquid supply unit configured to supply a liquid to a liquid ejection head of a liquid ejection apparatus, the liquid supply unit comprising:

a liquid containing body configured to contain the liquid;

a liquid injection portion that is provided in the liquid containing body and through which the liquid can be injected into the liquid containing body;

a housing that covers the liquid containing body; and a lever-shaped plug member configured to seal the liquid injection portion, wherein the plug member includes:

a first pivoting portion that is configured to pivot the plug member; and a first protrusion that is configured to lock the plug member onto the housing, the first protrusion having a distal end that is oriented towards the first pivoting portion, and the housing includes:

a second pivoting portion into which the first pivoting portion is to be fit; and a second protrusion that is provided so as to be displaceable, and is configured to come into contact with the first protrusion and be displaced when the plug member pivots toward the liquid injection portion, the contact with the protrusion being canceled and the displacement returning to normal when the plug member further pivots and is locked onto the housing.

7. The liquid supply unit according to claim 6, wherein the first protrusion and the second protrusion are arranged at a position at which the liquid injection portion is sealed by the plug member when the plug member pivots and is locked onto the housing.

8. The liquid supply unit according to claim 6, wherein the housing includes a third protrusion configured to, when the plug member pivots away from the liquid injection portion, restrict the pivoting of the plug member and perform locking by coming into contact with an end portion on the first pivoting portion side of the plug member.

9. The liquid supply unit according to claim 8, wherein the end portion is provided with a fourth protrusion configured to come into contact with the third protrusion when locked by the third protrusion.

10. The liquid supply unit according to claim 6, wherein the liquid containing body includes:

a first positioning portion configured to perform positioning on a mounting axis when mounted in the housing; and a pressed portion to be pressed from one direction on the mounting axis by the housing, the housing includes:

a first housing that covers the liquid containing body from one direction on the mounting axis;

a second housing opposing the first housing;

a second positioning portion that is provided in the second housing and is configured to lock the first positioning portion; and a pressing portion that is provided in the first housing and is configured to press the pressed portion in the one direction on the mounting axis, and in the liquid containing body, when the pressed portion is pressed by the pressing portion, the first positioning portion is locked onto the second positioning portion in conjunction with the pressing.

11. A liquid supply unit configured to supply a liquid to a liquid ejection head of a liquid ejection apparatus, the liquid supply unit comprising:

a liquid containing body configured to contain the liquid;

a liquid injection portion that is provided in the liquid containing body and through which the liquid can be injected into the liquid containing body; and a lever-shaped plug member configured to seal the liquid injection portion, wherein the plug member includes:

a first pivoting portion that is configured to pivot the plug member; and a first protrusion provided so as to be displaceable in order to lock the plug member onto the liquid containing body, the first protrusion having a distal end that is oriented towards the first pivoting portion, and the liquid containing body includes:

a second pivoting portion into which the first pivoting portion is to be fit; and a second protrusion configured to come into contact with the first protrusion and displace the first protrusion when the plug member pivots toward the liquid injection portion, the contact with the first protrusion being canceled and the displacement of the first protrusion being returned to normal when the plug member further pivots and is locked onto the liquid containing body.

12. The liquid supply unit according to claim 11, wherein the first protrusion and the second protrusion are arranged at a position at which the liquid injection portion is sealed by the plug member when the plug member pivots and is locked onto the liquid containing body.

13. The liquid supply unit according to claim 11, wherein the liquid containing body includes a third protrusion configured to, when the plug member pivots away from the liquid injection portion, restrict the pivoting of the plug member and perform locking by coming into contact with an end portion on the first pivoting portion side of the plug member.

14. The liquid supply unit according to claim 13, wherein the end portion is provided with a fourth protrusion configured to come into contact with the third protrusion when locked by the third protrusion.

15. A liquid supply unit configured to supply a liquid to a liquid ejection head of a liquid ejection apparatus, the liquid supply unit comprising:

a liquid containing body configured to contain the liquid;

a liquid injection portion that is provided in the liquid containing body and through which the liquid can be injected into the liquid containing body; and a lever-shaped plug member configured to seal the liquid injection portion, wherein the plug member includes:

a first pivoting portion that is configured to pivot the plug member; and a first protrusion that is configured to lock the plug member onto the liquid containing body, the first protrusion having a distal end that is oriented towards the first pivoting portion, and the liquid containing body includes:

a second pivoting portion into which the first pivoting portion is to be fit; and a second protrusion that is provided so as to be displaceable, and is configured to come into contact with the first protrusion and be displaced when the plug member pivots toward the liquid injection portion, the contact with the protrusion being canceled and the displacement returning to normal when the plug member further pivots and is locked onto the liquid containing body.

16. The liquid supply unit according to claim 15, wherein the first protrusion and the second protrusion are arranged at a position at which the liquid injection portion is sealed by the plug member when the plug member pivots and is locked onto the liquid containing body.

17. The liquid supply unit according to claim 15, wherein the liquid containing body includes a third protrusion configured to, when the plug member pivots away from the liquid injection portion, restrict the pivoting of the plug member and perform locking by coming into contact with an end portion on the first pivoting portion side of the plug member.

18. The liquid supply unit according to claim 17, wherein the end portion is provided with a fourth protrusion configured to come into contact with the third protrusion when locked by the third protrusion.

19. A liquid ejection apparatus, comprising:

a liquid ejection head; and the liquid supply unit according to claim 1.

20. The liquid supply unit according to claim 1, wherein the second protrusion of the housing has a distal end that is oriented away from the first pivoting portion.

* * * * *